US008950853B2

(12) United States Patent
Nozawa et al.

(10) Patent No.: US 8,950,853 B2
(45) Date of Patent: Feb. 10, 2015

(54) METHOD FOR MANUFACTURING CARTRIDGE, FILLING KIT, FILLING DEVICE, AND CARTRIDGE

(71) Applicant: Seiko Epson Corporation, Tokyo (JP)

(72) Inventors: Izumi Nozawa, Nagano (JP); Atsushi Kobayashi, Nagano (JP); Tadahiro Mizutani, Nagano (JP); Hiroyuki Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/011,862

(22) Filed: Aug. 28, 2013

(65) Prior Publication Data

US 2014/0063146 A1 Mar. 6, 2014

(30) Foreign Application Priority Data

Aug. 31, 2012 (JP) ..... 2012-191331

(51) Int. Cl.
*B41J 2/175* (2006.01)

(52) U.S. Cl.
CPC ..... *B41J 2/17506* (2013.01); *B41J 2/175* (2013.01); *B41J 2/17559* (2013.01)
USPC ..... 347/86

(58) Field of Classification Search
USPC ..... 347/86
See application file for complete search history.

(56) References Cited

U.S. PATENT DOCUMENTS

| | | | |
|---|---|---|---|
| 8,366,250 | B2 | 2/2013 | Wanibe et al. |
| 8,366,251 | B2 | 2/2013 | Wanibe et al. |
| 2009/0322832 | A1 | 12/2009 | Wanibe et al. |
| 2010/0073438 | A1 | 3/2010 | Wanibe et al. |

FOREIGN PATENT DOCUMENTS

| | | | |
|---|---|---|---|
| JP | 2010-005957 | A | 1/2010 |

*Primary Examiner* — Stephen Meier
*Assistant Examiner* — Alexander D Shenderov
(74) *Attorney, Agent, or Firm* — Global IP Counselors, LLP

(57) ABSTRACT

A method for manufacturing a cartridge includes a step (a) of preparing a cartridge, a step (b) of exposing at least a portion of a second film member, a step (c) of filling a printing material from a sub containing chamber by creating a hole in the second film member so as to cause the printing material to be contained in a printing material containing chamber after the step (b), and a step (d) closing the hole after the step (c).

18 Claims, 27 Drawing Sheets

F5–F5

F17-F17

METHOD FOR MANUFACTURING CARTRIDGE, FILLING KIT, FILLING DEVICE, AND CARTRIDGE

CROSS-REFERENCE TO RELATED APPLICATIONS

This application claims priority to Japanese Patent Application No. 2012-191331 filed on Aug. 31, 2012. The entire disclosure of Japanese Patent Application No. 2012-191331 is hereby incorporated herein by reference.

BACKGROUND

1. Technical Field

The present invention relates to a method for manufacturing a cartridge, an filling kit, an filling device, and a cartridge.

2. Related Art

Conventionally, a technique which uses an ink cartridge (simply referred to as a "cartridge") for containing ink has been known as a technique which supplies ink to a printer as an example of a printing device (for example, Japanese Unexamined Patent Application Publication No. 2010-5957). Such a cartridge is manufactured by filling ink into a printing material containing chamber for containing ink. The above mentioned publication also discloses a technique in which a cartridge is reused by filling ink into a used cartridge again so as to achieve the effective use of resources.

SUMMARY

As a cartridge for containing ink, various kinds of cartridges have been developed. For example, a type of cartridge has a printing material containing chamber and two printing material supply sections. This type of cartridge is often used together with another type of cartridge in which only one printing material supply section is provided. For example, a printing device is generally known, which is configured to mount a cartridge of a small volume in which only one printing material supply section is provided and a cartridge of a large volume in which two printing material supply sections are provided. In such a case, sometimes, the cartridge of a large volume has a larger volume of the inside of the containing chamber or has a more complicated configuration of the inside of the containing chamber compared to the cartridge of a small volume. Therefore, there is fear that that ink cannot be filled efficiently. For example, there is fear that ink cannot be contained efficiently in each region inside the printing material containing chamber when ink is filled. In addition, for example, there are cases where ink cannot be filled from a desired section.

As described above, the need in a cartridge is not limited to a cartridge for containing ink, but is common to a cartridge for containing another printing material or a printing material other than liquid. Also, in such a cartridge, reductions in size, reduction in cost, reduction in the use of resources, facilitation of manufacturing, improvements in usability, and the like have been desired.

The present invention has been made in order to at least partly solve the problems described above and can be achieved as the following aspects.

(1) According to an aspect of the present invention, there is proposed a method for manufacturing a cartridge which contains a printing material to be supplied to a printing device, the method including a step (a) of preparing a cartridge which has a printing material containing chamber for containing the printing material, and first and second printing material supply sections which supply the printing material contained in the printing material containing chamber to the printing device, the printing material containing chamber including a main containing chamber, a sub containing chamber which branches the printing material contained in the main containing chamber so as to the printing material flows into the first and second printing material supply sections, a first port through which the printing material contained in the main containing chamber flows into the sub containing chamber, a second port through which the printing material contained in the sub containing chamber flows into the first printing material supply section, and a third port through which the printing material contained in the sub containing chamber flows into the second printing material supply section, the sub containing chamber including a first sub containing chamber in which the first port is provided, a second sub containing chamber in which the second port is provided, and a third sub containing chamber in which the third port is provided, and the cartridge further including a first film member which is provided on a +Y axial direction side of the cartridge and forms side surfaces on the +Y axial direction side of the main containing chamber, the first sub containing chamber, and the second sub containing chamber, respectively, a second film member which is provided on a −Y axial direction side of the cartridge and forms side surfaces on the −Y axial direction side of the first sub containing chamber and the third sub containing chamber, respectively, and a lid member which is provided to cover the second film member, a step (b) of exposing at least a portion of the second film member, a step (c) of filling the printing material from the sub containing chamber by creating a hole in the second film member so as to cause the printing material to be contained in the printing material containing chamber after the step (b), and a step (d) closing the hole after the step (c).

Here, the first film member forms a side surface of the main containing chamber in addition to a side surface of the sub containing chamber. Therefore, in a case where a hole is created in the first film member to fill the printing material from the sub containing chamber, there is fear that a hole will be created inadvertently in a portion of the first film member which forms a side surface of the main containing chamber. According to the manufacturing method of the aspect, however, it is possible to prevent a hole from being created inadvertently in the first film member which is positioned on the opposite side of the second film member by creating a hole in the second film member and filling the printing material from the sub containing chamber when filling the printing material. As a result, it is possible to create a hole securely in the second film member, and it is thus possible to prevent a hole from being created inadvertently in a surface which forms the main containing chamber.

(2) In the method for manufacturing a cartridge of the aspect described above, in the cartridge prepared in the step (a), a flow path length from the first port to the third sub containing chamber may be longer than a flow path length from the first port to the second sub containing chamber, and a portion into which the printing material is filled in the step (c) may be located inside the third sub containing chamber.

According to the manufacturing method of this aspect, since the printing material is filled from the third sub containing chamber which has a long flow path length to the first port, the printing material can be filled efficiently into the third sub containing chamber which has a long flow path length and is hard to contain the printing material.

(3) In the method for manufacturing a cartridge of the aspect described above, a portion into which the printing material is filled in the step (c) may be located inside the first sub containing chamber.

According to the manufacturing method of this aspect, the printing material is filled from the first sub containing chamber. Thus, the printing material is branched from the first sub containing chamber, and the printing material can be filled in both of the second sub containing chamber and the third sub containing chamber at substantially the same time.

(4) In the method for manufacturing a cartridge of the aspect described above, the step (b) may include a step of attaching an elastic member to an exposed portion of the second film member, the hole in the second film member in the step (c) may be formed by piercing the elastic member and the exposed portion with an filling tool for filling the printing material into the printing material containing chamber, and the step (d) may be a step of extracting the filling tool from the elastic member and the exposed portion.

According to the manufacturing method of this aspect, the hole in the elastic member closes after extracting the filling tool. As a result, the hole formed in the second film member can be closed by the operation of extracting the filling tool. Therefore, the steps of the manufacturing method can be simplified compared to adding a step of closing the hole formed in the second film member after extracting the filling tool. Here, as for the elastic member, a solid member which has elasticity by being formed with rubber or the like can be used.

(5) The method for manufacturing a cartridge of the aspect described above may further include a step (e) of closing a first opening end which is located in an end portion of the first printing material supply section and a second opening end which is located in an end portion of the second printing material supply section before filling the printing material in the step (c).

According to the manufacturing method of this aspect, it is possible to prevent the printing material from leaking to the outside through the first and second opening ends when filling the printing material.

(6) In the method for manufacturing a cartridge of the aspect described above, the cartridge prepared in the step (a) may further include a first communicating path which connects the inside and the outside of the first printing material supply section, and a second communicating path which connects the inside and the outside of the second printing material supply section. One end side of the first communicating path may be a first inner path which is provided inside the first printing material supply section, and one end side of the second communicating path may be a second inner path which is provided inside the second printing material supply section. The method may further include a step (f) of closing the first and second inner paths before filling the printing material in the step (c).

According to the manufacturing method of this aspect, it is possible to prevent the printing material from leaking to the outside through the first and second inner paths when filling the printing material.

(7) The method for manufacturing a cartridge of the aspect described above may further include a step (g) of aspirating the printing material contained in the printing material containing chamber to the outside through the first and second printing material supply sections after the step (c).

According to the manufacturing method of this aspect, it is possible to contain the printing material inside the printing material supply section as well.

According to another aspect of the present invention, there is provided an filling kit or an filling device used for the method for manufacturing a cartridge of the aspect described above. The filling kit or the filling device has an filling unit which can fill the printing material into the printing material containing chamber from the outside.

Also, the filling kit or the filling device of the aspect described above may have an elastic member to be attached to the second film member.

Also, the filling kit or the filling device of the aspect described above may have an opening closing unit for closing a first opening end which is located in an end portion of the first printing material supply section and a second opening end which is located in an end portion of the second printing material supply section.

Also, the filling kit or the filling device of the aspect described above may have an inner path closing unit for closing a first inner path which is provided inside the first printing material supply section so as to connect the inside and the outside of the first printing material supply section and a second inner path which is provided inside the second printing material supply section so as to connect the inside and the outside of the second printing material supply section.

Also, the filling kit or the filling device of the aspect described above may have an aspirating unit for aspirating the printing material from the first and second printing material supply sections to the outside, respectively.

According to the filling kit or the filling device of the aspect described above, the printing material can be contained in the cartridge easily.

The plurality of constituent elements of each of the aspects of the present invention described above are not all essential and it is possible to appropriately perform modification, deletion, replacement with other new constituent elements, and deletion of a portion of limited content with regard to a portion of the plurality of constituent elements in order to solve a portion or all of the problems described above or to achieve a portion or all of the effects which are described in the specifications. In addition, an aspect which is independent of the present invention is possible by combining a portion or all of one technical aspect described above with a portion or all of the technical characteristics which are included in the other embodiments of the present invention described above in order to solve a portion or all of the problems described above or to achieve a portion or all of the effects which are described in the specifications.

For example, it is possible for one aspect of the present invention to be implemented as a method which includes one or more of the steps (a)-(d). That is, the manufacturing method may or may not have the step (a). In addition, the manufacturing method may or may not have the step (b). In addition, the manufacturing method may or may not have the step (c). In addition, the manufacturing method may or may not have the step (d). It is possible to implement such a manufacturing method, for example, as a method for manufacturing a cartridge, and also as a method other than a method for manufacturing a cartridge. According to such an aspect, it is possible to solve at least one of the various problems such as reductions in size, reduction in cost, reduction in the use of resources, facilitation of manufacturing, and improvements in usability of the article. It is possible for a portion, all or any of the technical characteristics of each of the aspects of the method for manufacturing a cartridge described above to be applied in such a method.

It is possible for the present invention to be implemented as various aspects other than the method for manufacturing a cartridge, the filling kit, the filling device, and the cartridge.

For example, it is possible for the invention to be implemented as aspects such as a method for filling a printing material, a method for manufacturing an filling kit or an filling device, a printing material system which is provided with a cartridge and a printing device, a printing material supply unit which is provided with a tube for supplying liquid (printing material) to a cartridge and a printing device, and the like.

BRIEF DESCRIPTION OF THE DRAWINGS

Referring now to the attached drawings which form a part of this original disclosure:

FIG. 23 is a first diagram for explaining an filling kit (filling device).

DETAILED DESCRIPTION OF EXEMPLARY EMBODIMENTS

Next, embodiments of the present invention will be explained in the following order: A, B. Embodiments; and C. Modified Example.

A. First Embodiment

A-1. Overall Configuration of Printing Material Supply System

Figure 1:
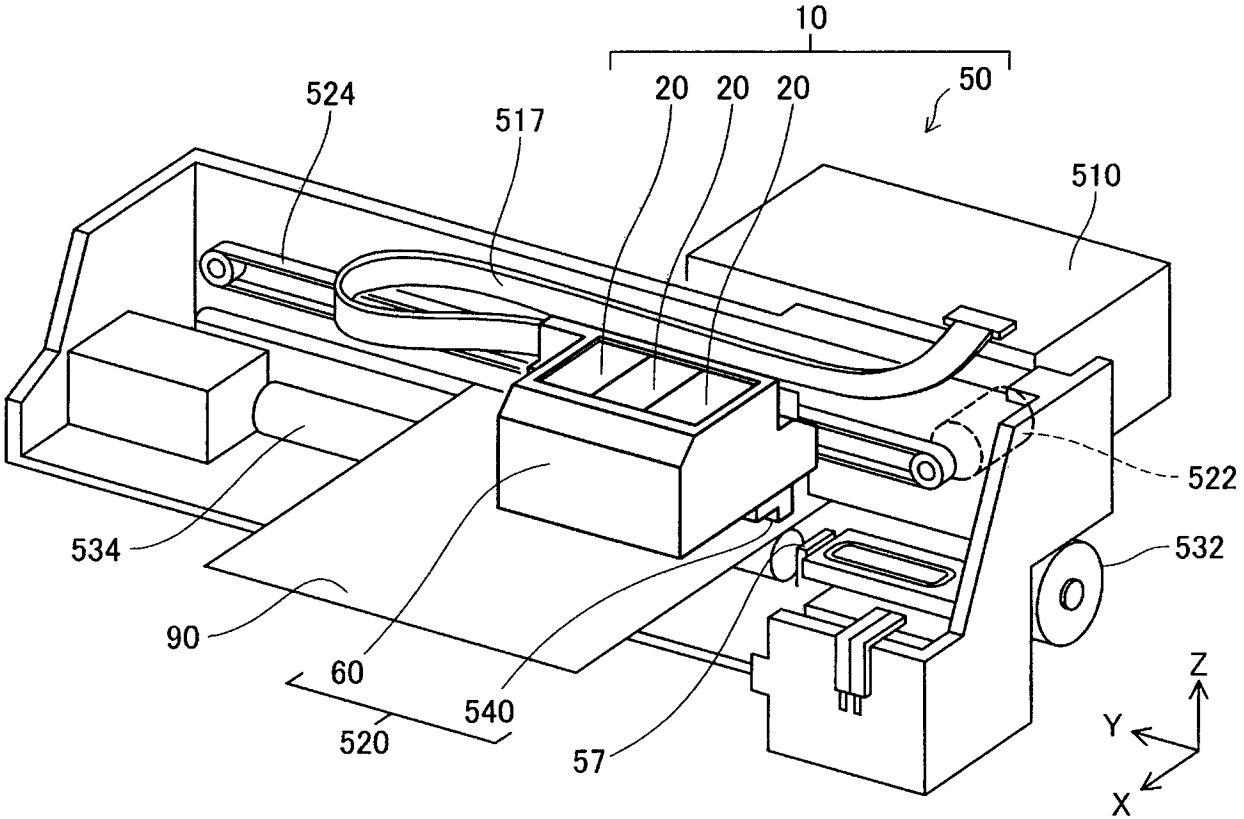
FIG. 1 is a perspective diagram illustrating a configuration of a printing material supply system 10.

FIG. 1 is a perspective diagram illustrating a configuration of a printing material supply system 10. X, Y, and Z axes are drawn to be orthogonal to each other in FIG. 1. The X, Y, and Z axes in FIG. 1 correspond to the X, Y, and Z axes in the other diagrams. In the present embodiment, the Z axial direction is the vertical direction.

The printing material supply system 10 is provided with a cartridge 20 and a printer (a printing device) 50. In the printing material supply system 10, the cartridge 20 is mounted to a holder (a cartridge mounting section) 60 of the printer 50, the cartridge 20 supplies ink (a printing material) to the printer 50, and printing is executed using the ink.

The cartridge 20 of the printing material supply system 10 is a device which has a function of containing ink and is also called an ink cartridge. The cartridge 20 is configured to be able to be attached and detached by the user with regard to the holder 60 of the printer 50. The ink in the cartridge 20 is supplied to a head 540 of the printer 50 from a printing material supply section described later which is provided in the cartridge 20 via a printing material supply pipe described later which is provided in the holder 60. Detailed configurations of the cartridge 20 and the holder 60 will be described later.

In the present embodiment, the holder 60 in the printer 50 is configured so that it is possible for three of the cartridges 20 to be mounted. The number of the cartridges 20 which are mounted in the holder 60 is not limited to three, it is possible to arbitrarily change the number, and there may be three or less or there may be three or more.

In the present embodiment, the ink in the cartridge 20 is black ink. In other embodiments, the ink in the cartridge 20 may be inks of various colors other than black such as yellow, magenta, light magenta, cyan, or light cyan, or ink where a special glossy color (metallic gloss, white pearl, or the like) is added to these colors. In other embodiments, each of the inks for the plurality of cartridges 20 which are mounted in the holder 60 may each be different types.

The printer 50 of the printing material supply system 10 is an ink jet printer which is a device for printing using ink. In addition to the holder 60 which holds the cartridge 20, the printer 50 is provided with a control section 510, a carriage 520, and the head 540. The printer 50 has a configuration where the ink is supplied from the cartridge 20 which is mounted in the holder 60 to the head 540. Information such as text, a diagram, or an image is printed onto a printing medium 90 such as paper or a label by the ink being discharged from the head 540 with regard to the printing medium 90.

The control section 510 of the printer 50 controls each section of the printer 50. The carriage 520 of the printer 50 is configured to be able to relatively move the head 540 with regard to the printing medium 90. The head 540 of the printer 50 receives supply of the ink from the cartridge 20 which is mounted in the holder 60 and discharges the ink to the printing medium 90. The control section 510 and the carriage 520 are electrically connected via a flexible cable 517 and the head 540 executes discharge of the ink based on a control signal from the control section 510.

In the present embodiment, the holder 60 is provided in the carriage 520 and the cartridge 20 is mounted above the carriage 520. Such a printer is referred to as an on-carriage printer. In other embodiments, the holder 60 may be provided in a portion which is different to the carriage 520 and the ink may be supplied from the cartridge 20 to the head 540 above the carriage 520 via a flexible tube. Such a type of printer is referred to as an off-carriage type.

In the present embodiment, the printer 50 is provided with a main scanning and feeding mechanism and a sub scanning and feeding mechanism for realizing printing with regard to the printing medium 90 by relatively moving the carriage 520 and the printing medium 90. The main scanning and feeding mechanism of the printer 50 is provided with a carriage motor 522 and a driving belt 524, and the carriage 520 is moved so as to reciprocate in the main scanning direction by motive force from the carriage motor 522 being transferred to the carriage 520 via the driving belt 524. The sub scanning and feeding mechanism of the printer 50 is provided with a transport motor 532 and a platen 534, and the printing medium 90 is transported in the sub scanning direction which is orthogonal to the main scanning direction by motive force from the transport motor 532 being transferred to the platen 534. The carriage motor 522 of the main scanning and feeding mechanism and the transport motor 532 of the sub scanning and feeding mechanism are operated based on control signals from the control section 510.

In the present embodiment, in the usage state of the printing material supply system 10, an axis along the sub scanning direction where the printing medium 90 is transported is set as the X axis, an axis along the main scanning direction where the carriage 520 is moved so as to reciprocate is set as the Y axis, and an axis along the direction of gravity is set as the Z axis. The X axis, the Y axis, and the Z axis are orthogonal to each other. Here, the usage state of the printing material supply system 10 is a state of the printing material supply system 10 which is arranged on a horizontal surface, and in the present embodiment, the horizontal surface is a surface which is parallel to the X axis and the Y axis.

In the present embodiment, the +X axial direction is toward the sub scanning direction and the opposite is the −X axial direction, and the +Z axial direction is from below to above in the direction of gravity and the opposite is the −Z axial direction. In the present embodiment, the +X axial direction side is the front surface of the printing material supply system 10. In the present embodiment, the +Y axial direction is toward the left side surface from the right side surface of the printing material supply system 10 and the opposite is the −Y axial direction. In the present embodiment, the alignment direction of the plurality of cartridges 20 which are mounted in the holder 60 is a direction along the Y axis.

A detection section 57 is provided in a position other than a printing region of the printer 50 to optically detect the remaining amount of ink in the cartridge 20. A light emitting section and a light receiving section are provided inside the detection section 57. When the cartridge 20 passes above the detection section 57 in accordance with movement of a carriage 520, a control section 510 causes the light emitting section of the detection section 57 to emit light, and the presence or absence of ink in the cartridge 20 is detected based on whether the light receiving section of the detection section 57 receives the light. Here, "the absence of ink" includes a state where only little ink remains.

A-2. Configuration where Cartridge is Mounted in Holder

Figure 2:
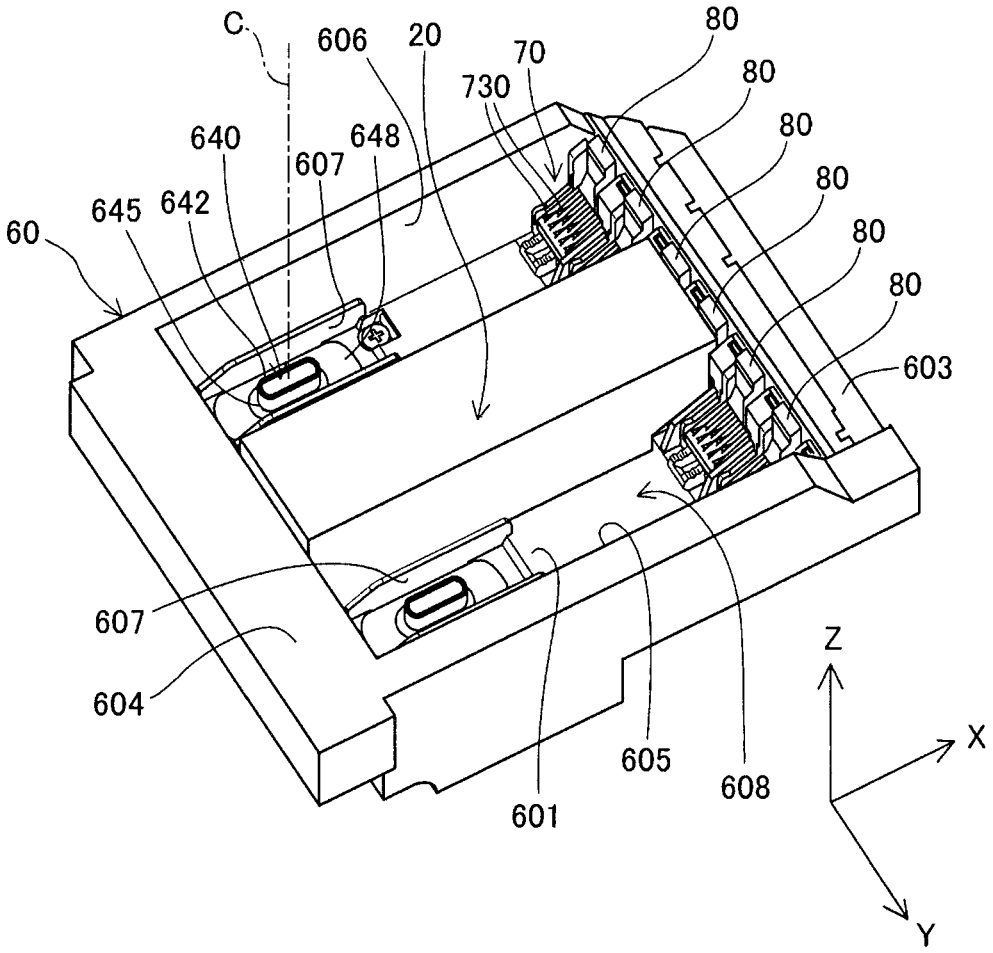
FIG. 2 is a perspective diagram illustrating a holder where a cartridge is mounted.
Figure 3:
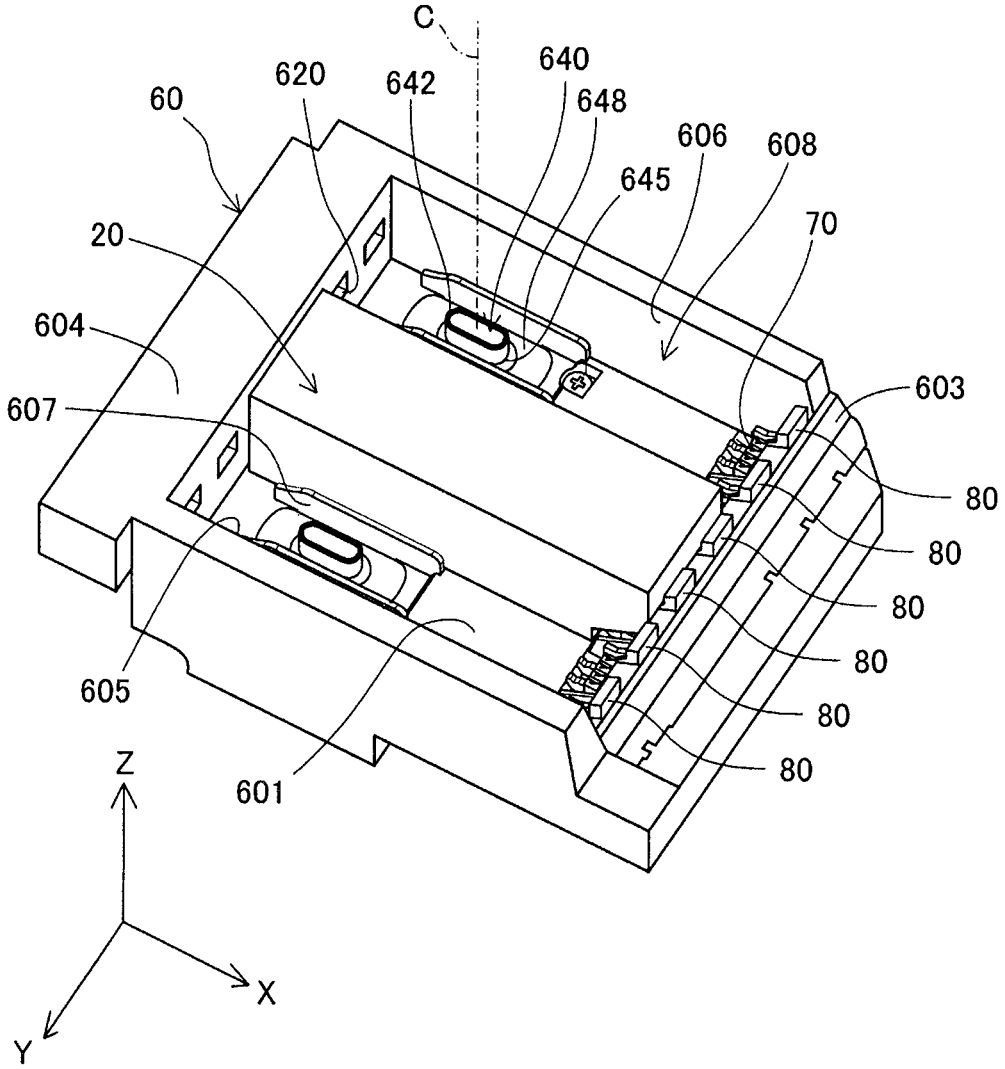
FIG. 3 is a perspective diagram illustrating a holder where a cartridge is mounted.
Figure 4:
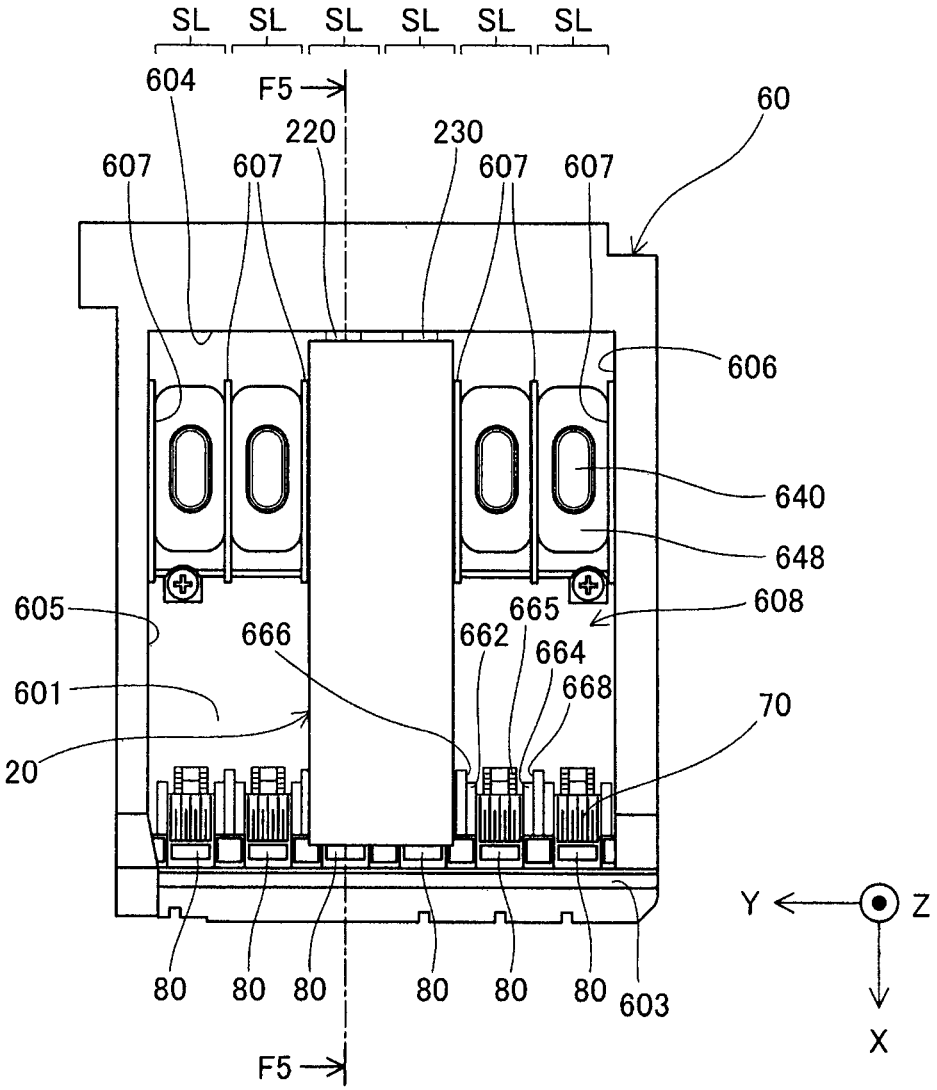
FIG. 4 is an upper surface diagram illustrating a holder where a cartridge is mounted.
Figure 5:
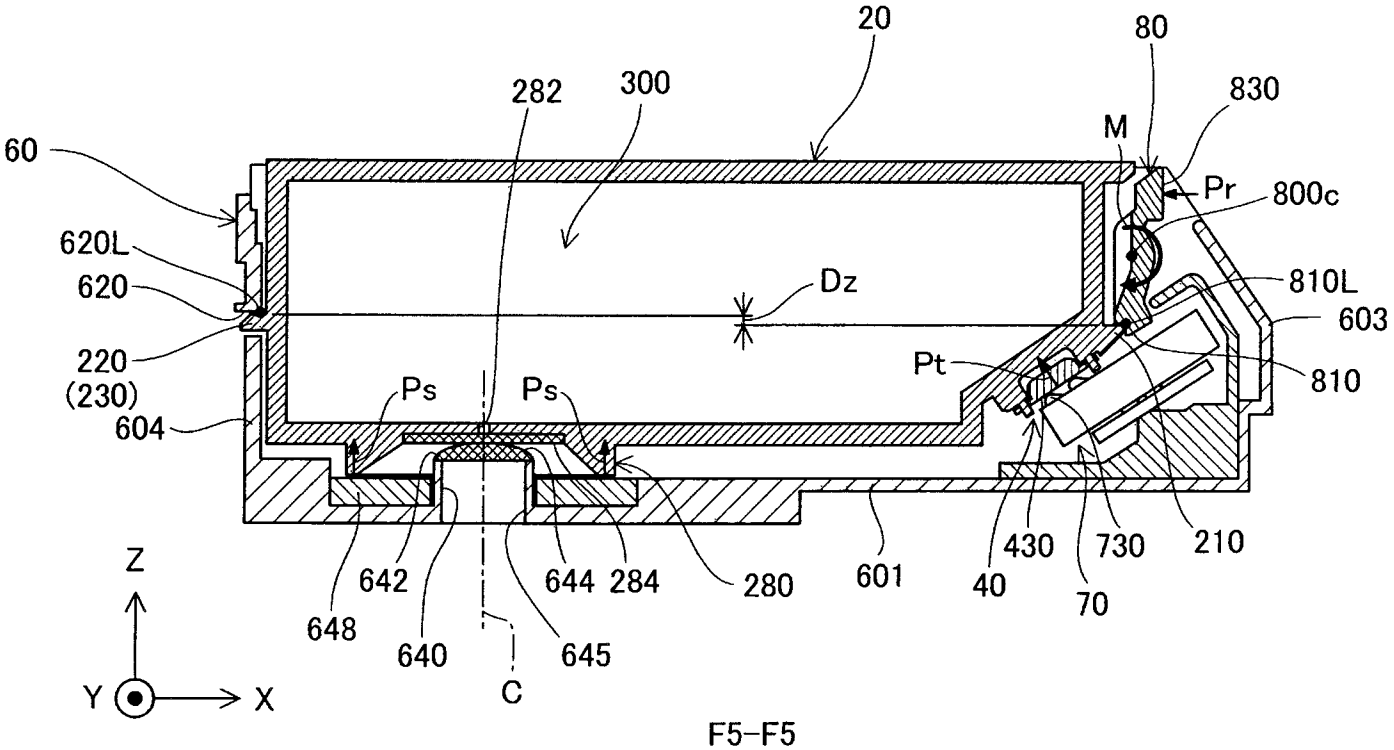
FIG. 5 is a cross-sectional diagram cut along an arrow F5-F5 in FIG. 4.
Figure 6:
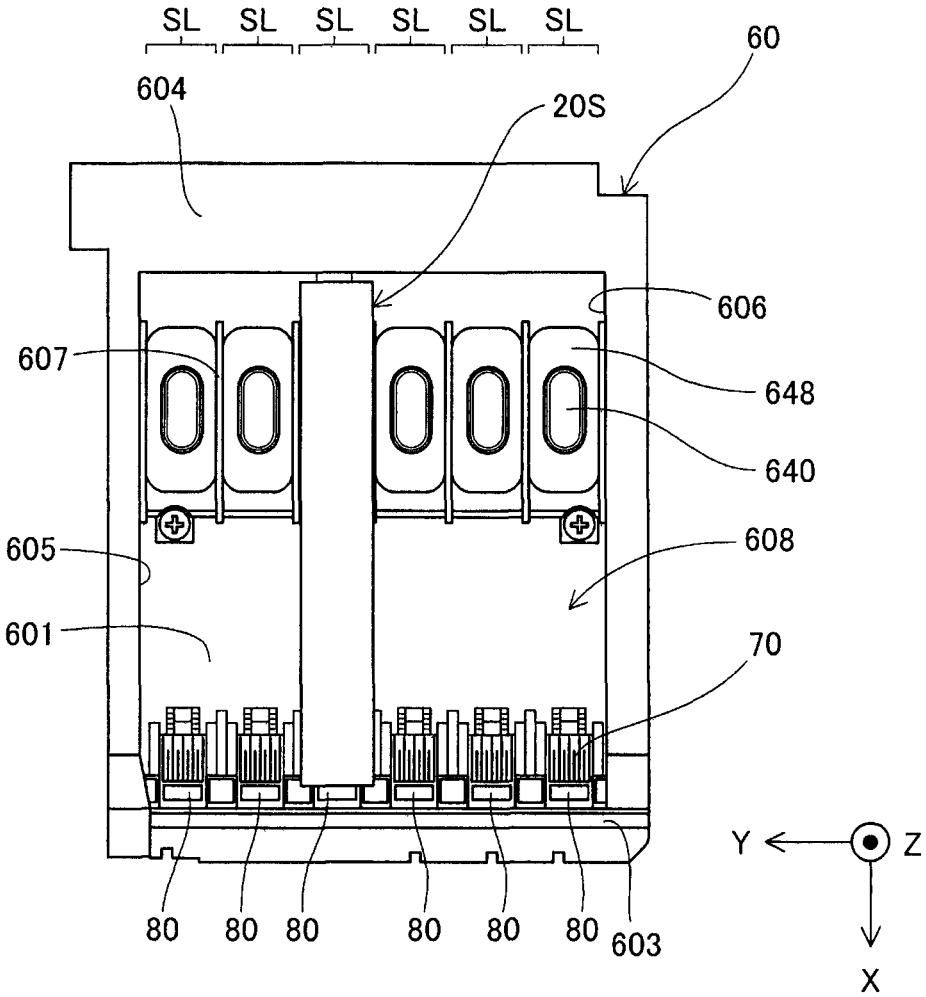
FIG. 6 is an upper surface diagram illustrating a holder where a cartridge is mounted.

FIG. 2 and FIG. 3 are perspective diagrams illustrating the holder 60 where the cartridge 20 is mounted. FIG. 4 is an upper surface diagram illustrating the holder 60 where the cartridge 20 is mounted. FIG. 5 is a cross-sectional diagram illustrating the holder 60, where the cartridge 20 is mounted, cut along an arrow F5-F5 in FIG. 4. FIG. 6 is an upper surface diagram illustrating the holder 60 where a different cartridge 20S is mounted. A state is illustrated in FIG. 2 to FIG. 5 where one of the cartridges 20 is correctly mounted in a designed mounting position in the holder 60. A state is illustrated in FIG. 6 where one of the cartridges 20S is correctly mounted in a designed mounting position in the holder 60.

The holder 60 of the printer 50 has a wall section 601, a wall section 603, a wall section 604, a wall section 605, a wall section 606, and the five wall sections form a cartridge mounting space 608 which is a space for receiving the cartridge 20. The wall section 601 defines the −Z axial direction side of the cartridge mounting space 608. The wall section 603 defines the +X axial direction side of the cartridge mounting space 608. The wall section 604 defines the −X axial direction side of the cartridge mounting space 608. The wall section 605 defines the +Y axial direction side of the cartridge mounting space 608. The wall section 606 defines the −Y axial direction side of the cartridge mounting space 608.

The printer 50 is provided with a plurality of ink supply pipes (printing material supply pipes) 640 in the cartridge mounting space 608 of the holder 60. The plurality of ink supply pipes 640 are provided to extend toward the +Z axial direction from the wall section 601.

A partition plate 607 is provided to extend between the two of the ink supply pipes 640 which are adjacent to each other out of the plurality of ink supply pipes 640. In the present embodiment, in addition to between the two of the ink supply pipes 640 which are adjacent to each other, the partition plates 607 are provided at both ends of the lineup of the plurality of ink supply pipes 640 (that is, the +Y axial direction side and the −Y axial direction side). In the present embodiment, the partition plate 607 is a member with a plate shape parallel to the ZX plane which passes through the Z axis and the X axis. In the present embodiment, the partition plate 607 extends from the wall section 601 in the +Z axial direction. In the present embodiment, the partition plate 607 extends in the +Z axial direction side with respect to a tip end section 642 of the ink supply pipe 640. In the present embodiment, the length of the partition plate 607 along the X axis is larger than the length of the ink supply pipe 640 along the X axis.

As shown in FIG. 4 and FIG. 6, the cartridge mounting space 608 is divided into a plurality of slots SL for each of the ink supply pipes 640 by the partition sections 607. In the present embodiment, as shown in FIG. 4, it is possible to mount one of the cartridges 20 in two of the slots SL which are adjacent to each other. As shown in FIG. 6, other than the cartridge 20, the holder 60 is configured so that it is possible to mount the cartridge 20S where the width of the cartridge 20 in the Y axial direction has been substantially halved, and it is possible to mount one of the cartridges 20S in each of the slots SL. As shown in FIG. 2 to FIG. 5, in addition to the ink supply pipes 640, the printer 50 is provided with a terminal platform 70, a lever 80, a terminal platform side fastening section 810, a supply pipe side fastening section 620, and engaging sections 662, 664, 665, 666, and 668 in each of the slots SL in the holder 60.

As shown in FIG. 4 and FIG. 5, the cartridge 20 is provided with a circuit substrate 40, a substrate side fastening section 210, supply section side fastening sections 220 and 230, two ink supply sections (printing material supply sections) 280, an ink containing section (a printing material containing section) 300 to match with the two slots SL which are adjacent to each other in the holder 60. FIG. 5 schematically illustrates the ink containing section 300. The details of the ink containing section 300 will be described later.

In the present embodiment, an ink flow path 282 is formed to be linked in common with the ink containing section 300 in each of the two ink supply sections 280 of the cartridge 20 and it is possible for the ink to be supplied from the ink containing section 300 to the outside of the cartridge 20 via the ink flow path 282. In the present embodiment, a leakage preventing member 284, which prevents unintentional leakage of the ink from the ink flow path 282, is provided at an exit port side of the ink flow path 282 in each of the ink supply sections 280. The leakage preventing member 284 shown in FIG. 5 is simplified.

The ink supply pipe 640 of the printer 50 is configured so that it is possible for ink to be supplied from the ink containing section 300 of the cartridge 20 to the head 540 by being connected to the ink supply section 280 of the cartridge 20. The ink supply pipe 640 has the tip end section 642 which is connected to the cartridge side. A base end section 645 of the ink supply pipe 640 is provided at the wall section 601 which is the bottom surface of the holder 60. In the present embodiment, as shown in FIG. 5, a central axis C of the ink supply pipe 640 is parallel to the Z axis and a direction, which is from the base end section 645 of the ink supply pipe 640 toward the tip end section 642 along the central axis C, is the +Z axial direction.

In the present embodiment, a porous filter 644 which filters the ink from the cartridge 20 is provided in the tip end section 642 of the ink supply pipe 640. As the porous filter 644, for example, it is possible to use a stainless steel mesh, a stainless steel non-woven fabric, or the like. In other embodiments, the porous filter may be omitted from the tip end section 642 of the ink supply pipe 640.

In the present embodiment, an elastic member 648, which prevents leakage of the ink from the ink supply section 280 to the surroundings by tightly sealing the ink supply section 280 of the carriage 20, is provided in the surroundings of the ink supply pipe 640 as shown in FIG. 2 to FIG. 5. A pressing force Ps (FIG. 5) which includes components in the +Z axial direction is imparted from the elastic member 648 with regard to the ink supply section 280 in the cartridge 20 in a state of being mounted in the holder 60.

As shown in FIG. 5, the terminal platform 70 of the printer 50 is provided on the +X axial direction side with respect to the ink supply pipe 640. Device side terminals 730 are provided in the terminal platform 70 so as to be able to be electrically connected to cartridge side terminals 430 which are provided in the circuit substrate 40 of the cartridge 20. A pressing force Pt which includes components in the +Z axial direction is imparted from the terminal platform 70 with regard to the circuit substrate 40 in the cartridge 20 in a state of being mounted in the holder 60.

The terminal platform side fastening section 810 in the printer 50 is provided in the wall section 603 of the holder 60 as a portion of the lever 80 and fastens to the substrate side fastening section 210 at a first fastening position 810L. The first fastening position 810L is positioned on the +Z axial direction side and the +X axial direction side with respect to a position where the circuit substrate 40 and the terminal platform 70 come into contact. The terminal platform side fastening section 810 limits movement of the cartridge 20 in the +Z axial direction by fastening to the substrate side fastening section 210.

The supply pipe side fastening section 620 in the printer 50 is provided in the wall section 604 of the holder 60 and is configured to be able to fasten to the supply section side fastening sections 220 and 230 at a second fastening position 620L. The second fastening position 620L is positioned on the +Z axial direction side and the −X axial direction side with respect to the ink supply pipe 640. The supply pipe side fastening section 620 limits movement of the cartridge 20 in the +Z axial direction by fastening to the supply section side fastening sections 220 and 230.

Attaching and detaching of the cartridge 20 is performed while the cartridge 20 is rotated along a plane which is parallel to the Z axis and the X axis with the vicinity of the supply section side fastening section 220 and the supply pipe side fastening section 620 as a rotation pivot during attaching and detaching of the cartridge 20 with regard to the holder 60.

The lever 80 of the printer 50 has a rotation pivot 800*c* on the +Z axial direction side and the +X axial direction side with respect to the first fastening position 810L where the terminal platform side fastening section 810 is fastened to the substrate side fastening section 210. Therefore, a rotation moment M is generated in a direction shown in FIG. 5 in the lever 80 when the cartridge 20 attempts to move in the +Z axial direction. As a result, it is possible to prevent unintentional releasing of the fastening of the substrate side fastening section 210 due to the terminal platform side fastening section 810.

The lever 80 is configured such that fastening and releasing of the fastening to the substrate side fastening section 210 using the terminal platform side fastening section 810 is possible due to the rotation of the lever 80 which moves the terminal platform side fastening section 810 from the first fastening location 810L in the +X axial direction. In the present embodiment, an operation section 830, which is configured so that it is possible to receive an operation force Pr toward the −X axial direction due to the user, is formed in the lever 80 on the +Z axial direction side and the +X axial direction side with respect to the rotation pivot 800*c*. When the operation force Pr is imparted to the operation section 830 by the user, the fastening of the substrate side fastening section 210 using the terminal platform side fastening section 810 is released by the lever 80 being rotated so that the terminal platform side fastening section 810 moves from the first fastening location 810L in the +X axial direction. Consequently, it is possible for the cartridge 20 to be removed from the holder 60.

As shown in FIG. 5, in a state where the cartridge 20 is mounted in the holder 60, the first fastening position 810L is positioned on the −Z axial direction side with respect to the second fastening position 620L with a distance Dz. Therefore, the pressing forces Ps and Pt from the holder 60 with regard to the cartridge 20 act in a direction which strengthens the fastening of the substrate side fastening section 210 and the terminal platform side fastening section 810 (a direction which includes +X axial components and +Z axial components) due to a relationship of balancing the moment with the second fastening position 620L as the rotation pivot of the cartridge 20. Consequently, it is possible to stably maintain the cartridge 20 in the designed mounting position.

The engaging sections 662, 664, 665, 666, and 668 of the printer 50 engage with each section of the cartridge 20. Consequently, it is possible to prevent positional deviation of the circuit substrate 40 with regard to the holder 60 in the Y axial direction and it is possible for the cartridge side terminals 430 to come into contact with the device side terminals 730 in the correct position.

A-3. Detailed Configuration of Cartridge

Figure 7:
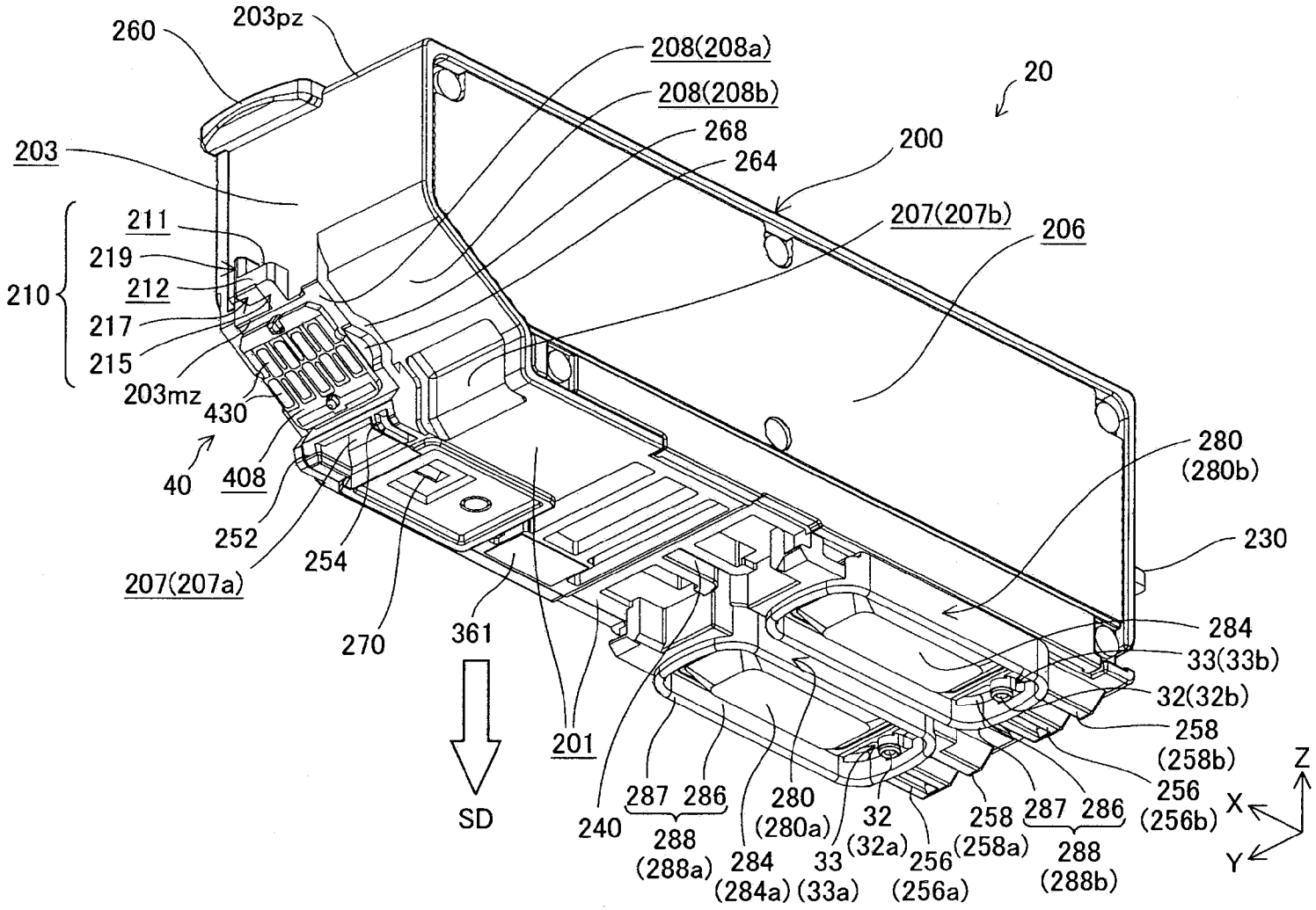
FIG. 7 is a perspective diagram illustrating a configuration of a cartridge.
Figure 8:
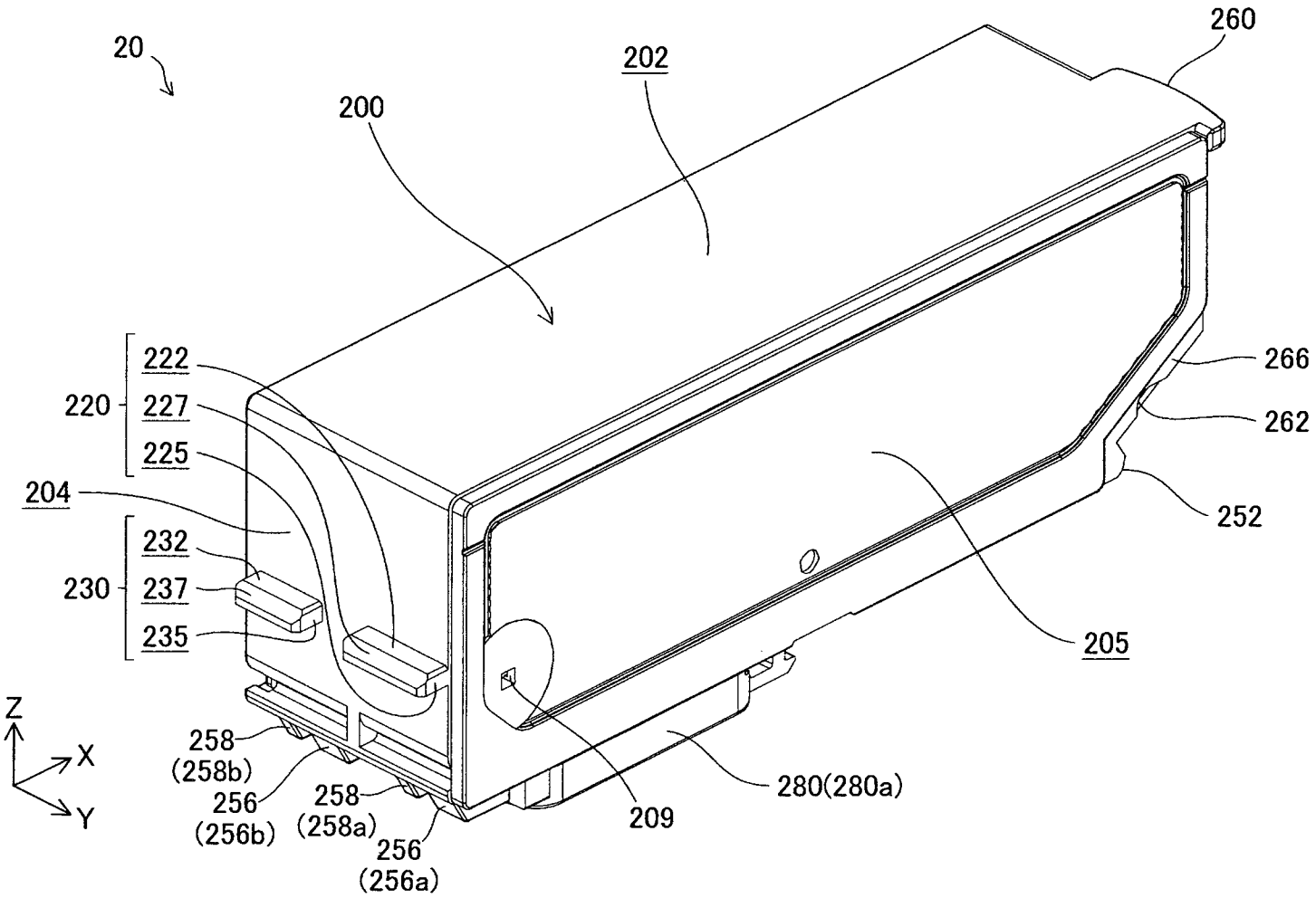
FIG. 8 is a perspective diagram illustrating a configuration of a cartridge.
Figure 9:
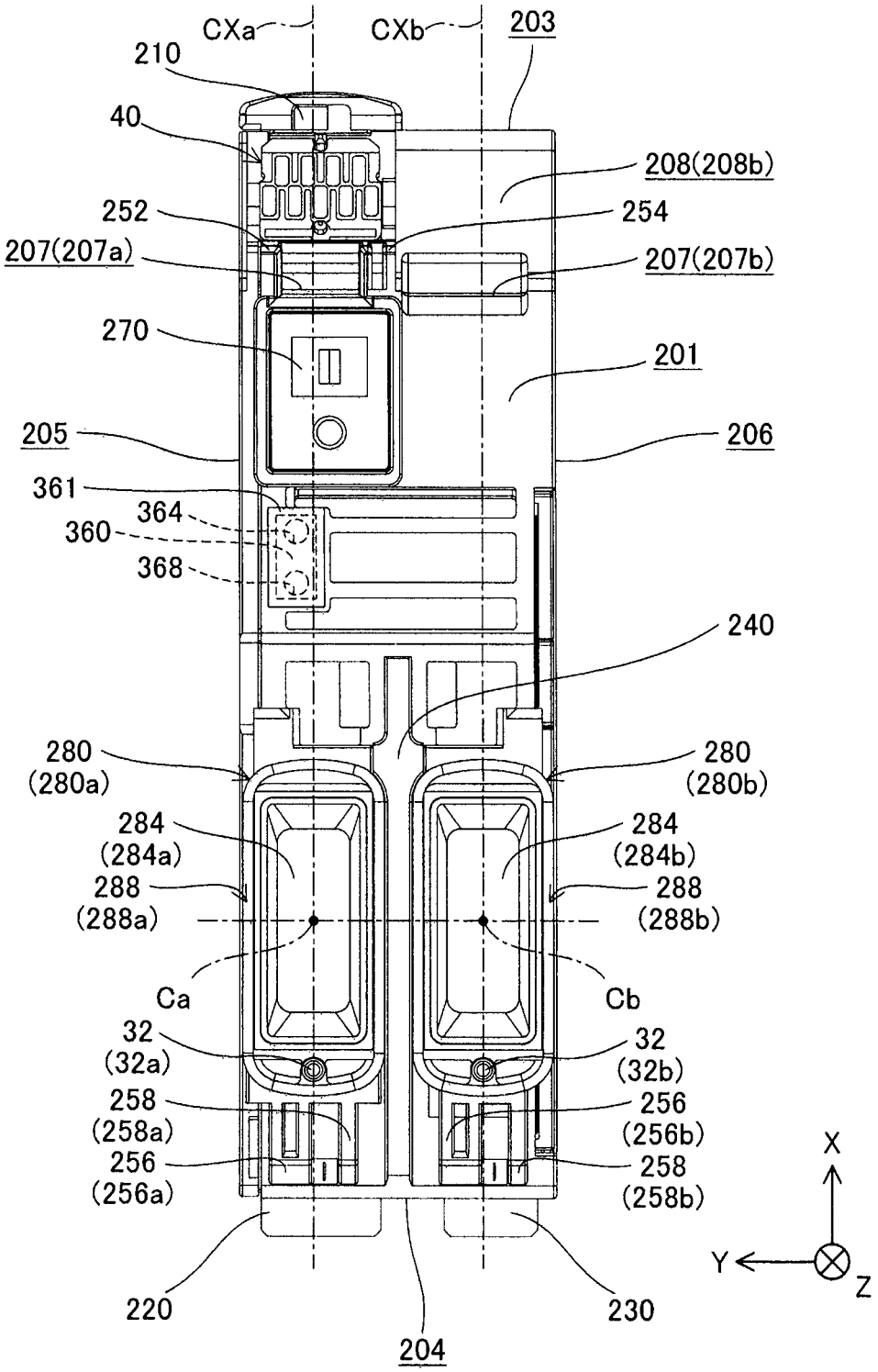
FIG. 9 is a bottom surface diagram illustrating a configuration of a cartridge.
Figure 10:
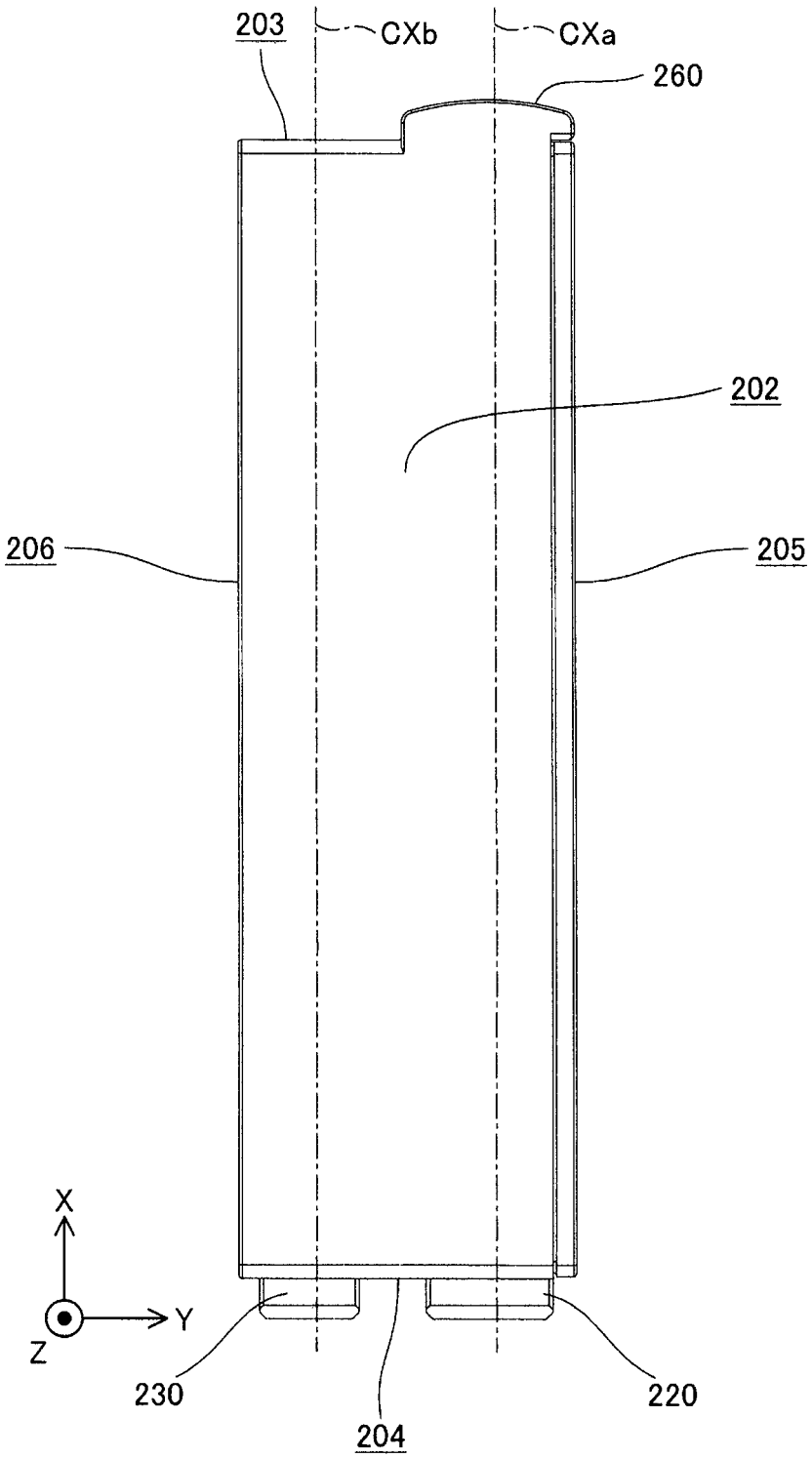
FIG. 10 is an upper surface diagram illustrating a configuration of a cartridge.
Figure 11:
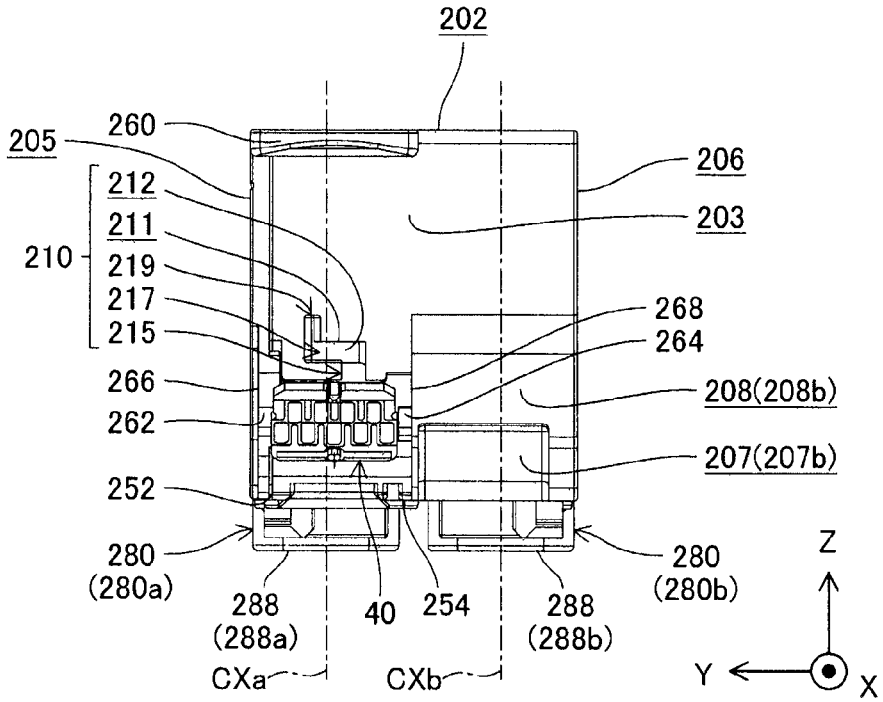
FIG. 11 is a front surface diagram illustrating a configuration of a cartridge.
Figure 12:
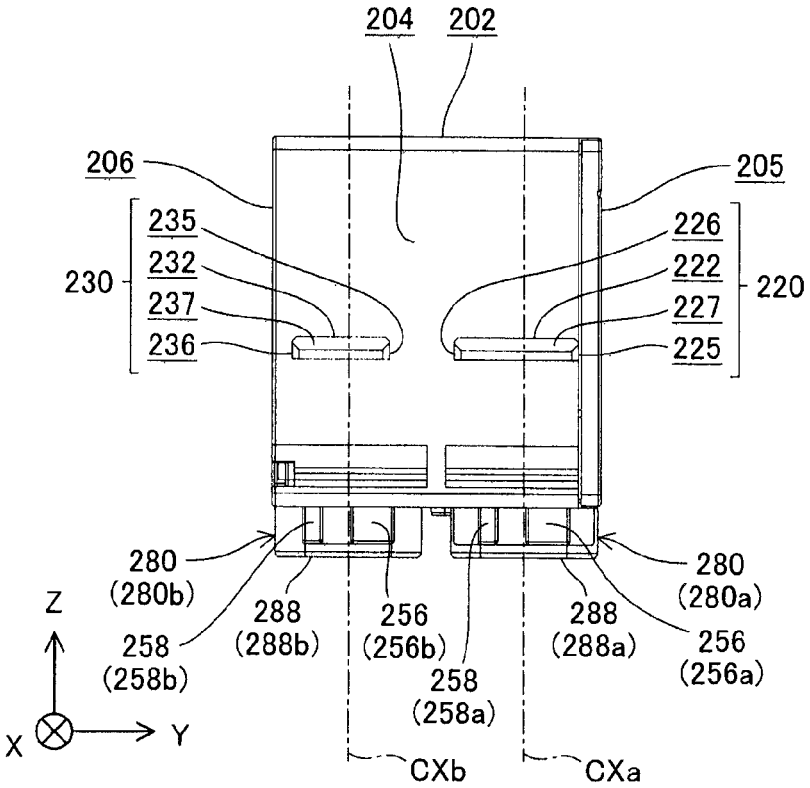
FIG. 12 is a rear surface diagram illustrating a configuration of a cartridge.
Figure 13:
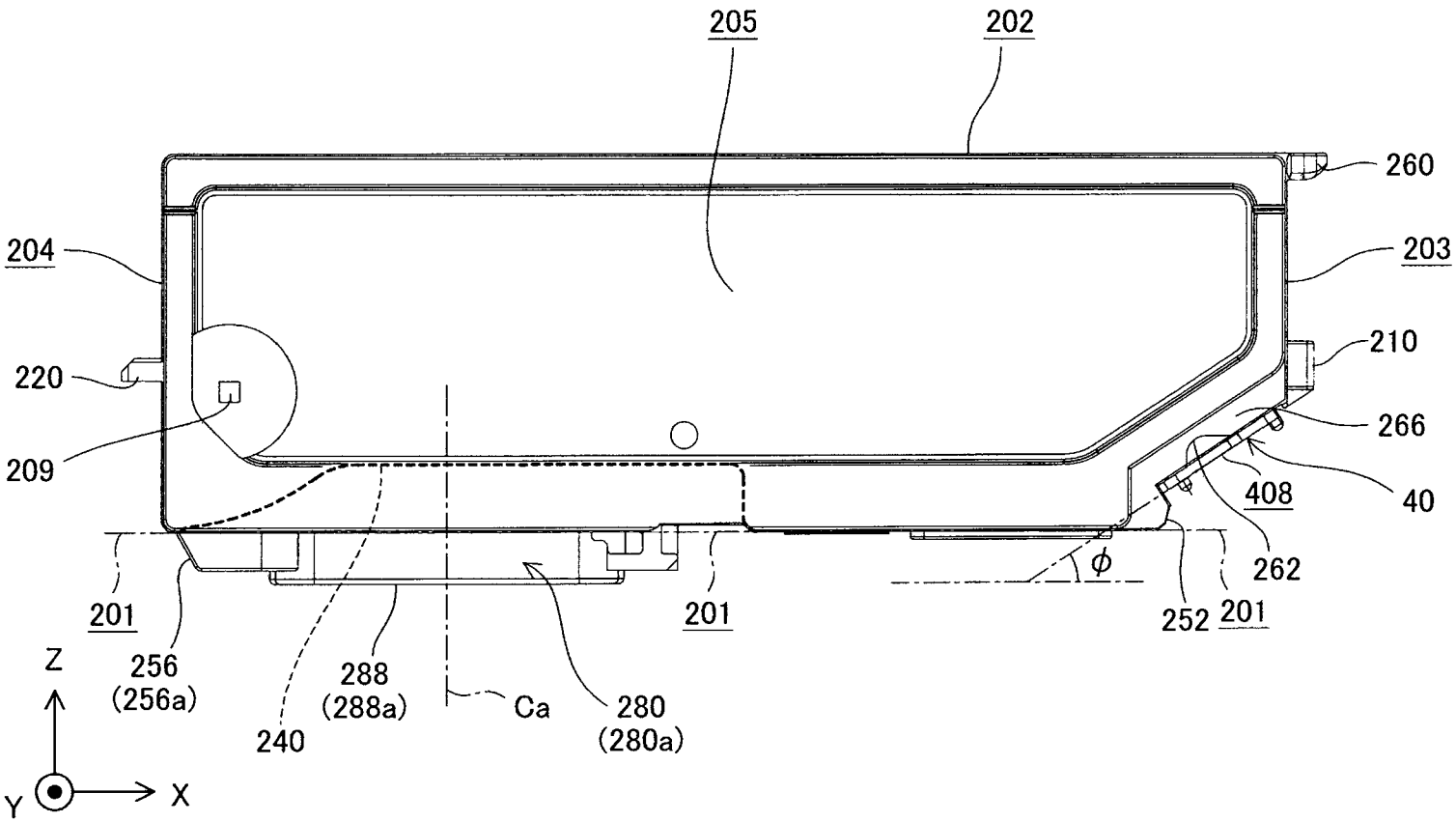
FIG. 13 is a left side surface diagram illustrating a configuration of a cartridge.
Figure 14:
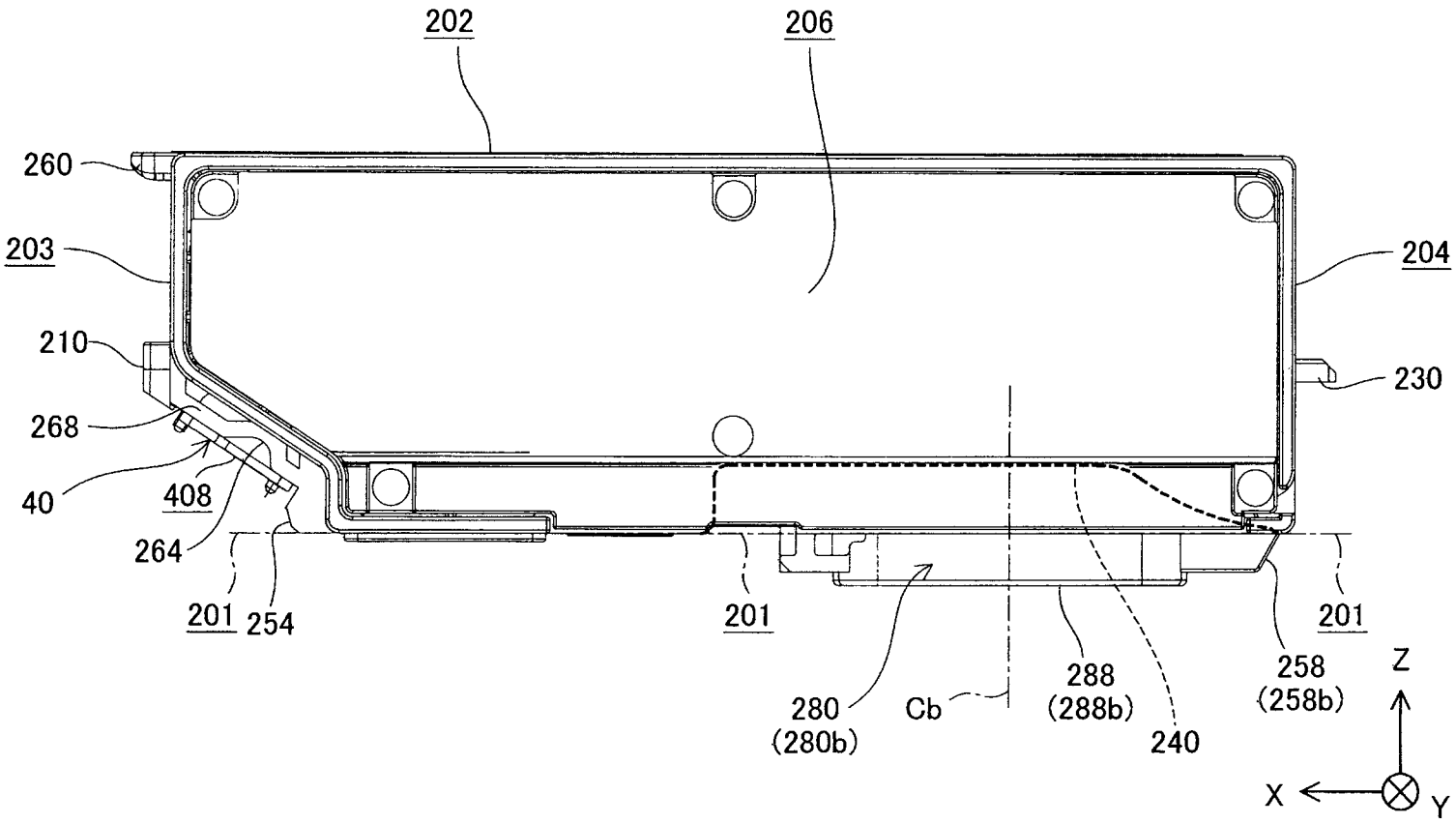
FIG. 14 is a right side surface diagram illustrating a configuration of a cartridge.
Figure 15:
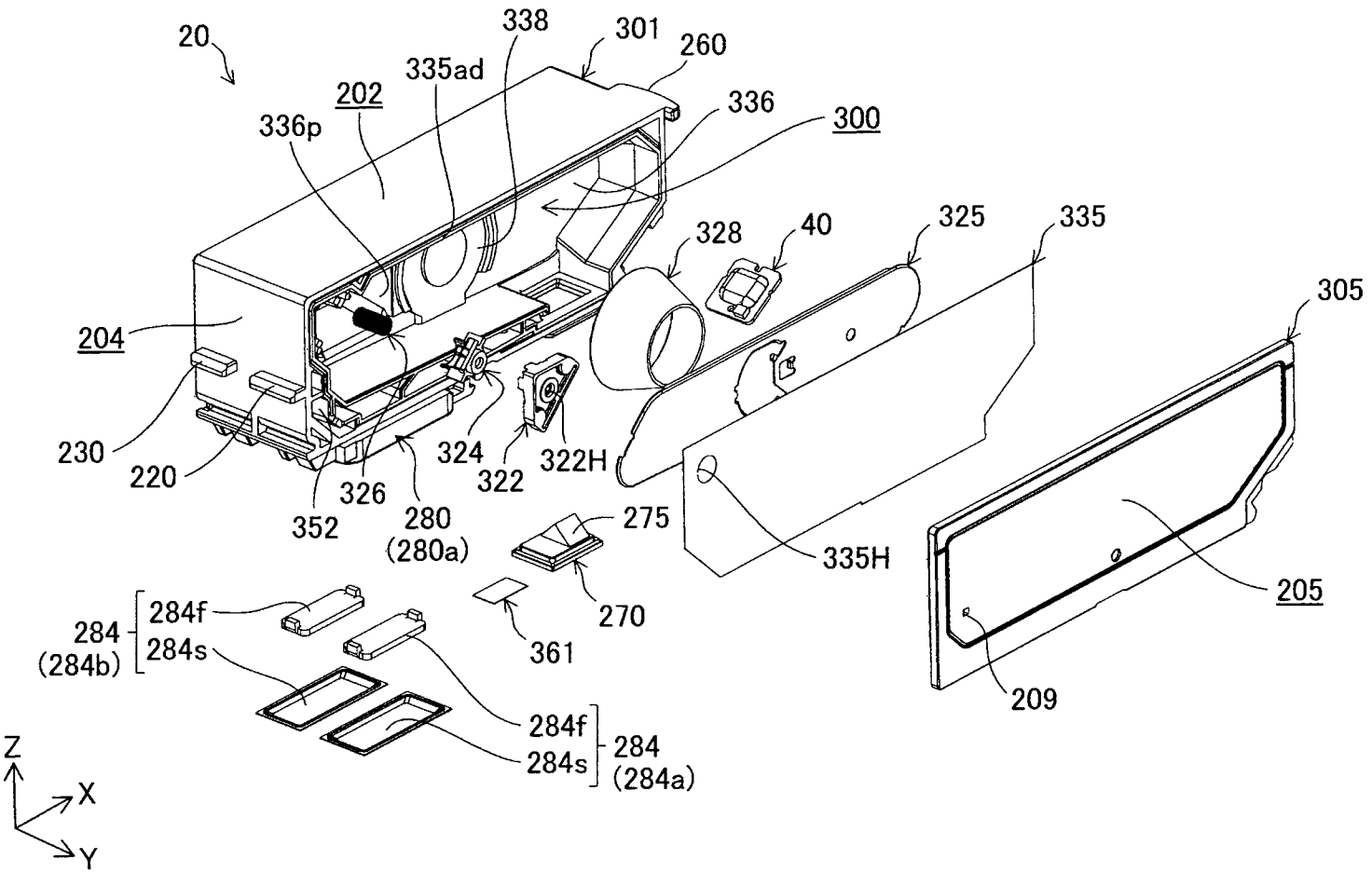
FIG. 15 is an exploded perspective diagram illustrating a configuration of a cartridge.
Figure 16:
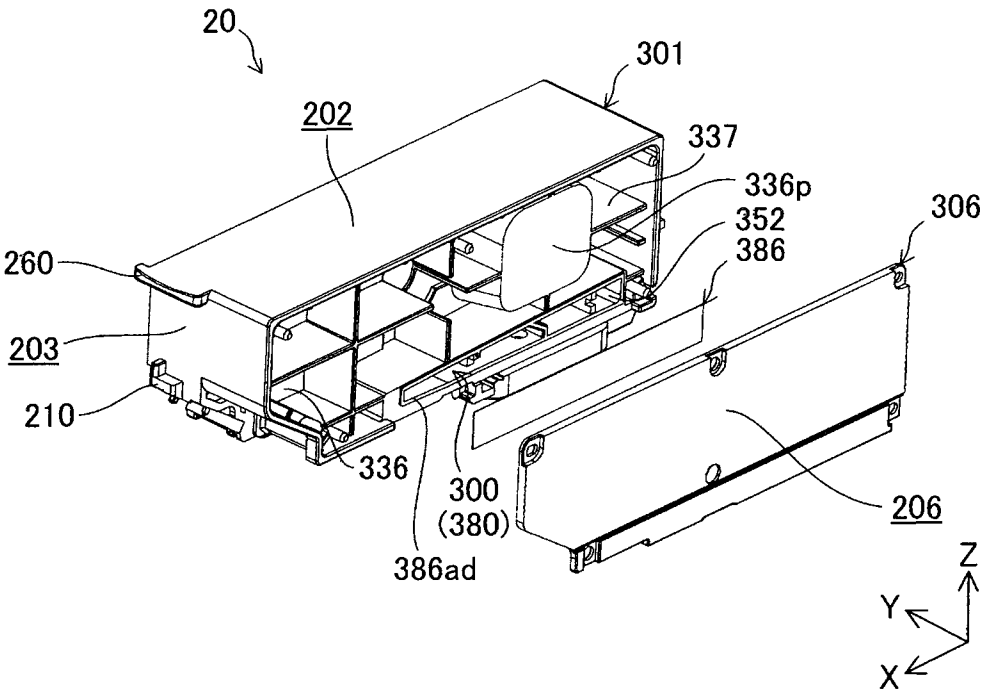
FIG. 16 is an exploded perspective diagram illustrating a configuration of a cartridge.

FIG. 7 and FIG. 8 are perspective diagrams illustrating the configuration of the cartridge 20. FIG. 9 is a bottom surface diagram illustrating the configuration of the cartridge 20. FIG. 10 is an upper surface diagram illustrating the configuration of the cartridge 20. FIG. 11 is a front surface diagram illustrating the configuration of the cartridge 20. FIG. 12 is a rear surface diagram illustrating the configuration of the cartridge 20. FIG. 13 is a left side surface diagram illustrating the configuration of the cartridge 20. FIG. 14 is a right side surface diagram illustrating the configuration of the cartridge 20. FIG. 15 and FIG. 16 are exploded perspective diagrams illustrating the configuration of the cartridge 20.

In the explanation of the cartridge 20, the X axis, the Y axis, and the Z axis are axes on the cartridge with regard to the cartridge 20 which is in the mounting state of being mounted in the holder 60. In the present embodiment, the +X axial direction side is the front surface of the cartridge 20 in the mounting state where the cartridge 20 is mounted in the holder 60. In the present embodiment, a mounting direction SD when the cartridge 20 is mounted in the holder 60 is the −Z axial direction.

In the explanation of the present embodiment, a reference numeral "280" is used in cases where both of the two ink supply sections 280 in the cartridge 20 are being referred to, a reference numeral "280*a*" is used in cases indicating the ink supply section on the +Y axial direction side, and a reference numeral "280*b*" is used in cases indicating the ink supply section on the −Y axial direction side. Further, the two ink supply sections 280 have the same elements, respectively. Therefore, the same reference numeral is used in cases where both of the elements of the two ink supply sections 280 are being referred to, "a" is used at the end of the reference numeral in cases indicating the element of the ink supply section 280*a* on the +Y axial direction side, and "b" is used at the end of the reference numeral in cases indicating the element of the ink supply section 280*b* on the −Y axial direction side.

A central axis Ca shown in FIG. 9 and FIG. 13 corresponds to the central axis C of the ink supply pipe 640 which is connected to the ink supply section 280*a* in the mounting state where the cartridge 20 is mounted in the holder 60, and in the present embodiment, is the central axis of the ink supply section 280*a*. A plane CXa shown in FIG. 9 to FIG. 12 is a plane which passes through the central axis Ca and which is parallel to the Z axis and the X axis. That is, the plane CXa is a plane which passes through the center of the length along the Y axis of the ink supply section 280*a* and is orthogonal to the Y axis.

A central axis Cb shown in FIG. 9 and FIG. 14 corresponds to the central axis C of the ink supply pipe 640 which is connected to the ink supply section 280*b*, and in the present embodiment, is the central axis of the ink supply section 280*b*. A plane CXb shown in FIG. 9 to FIG. 12 is a plane which passes through the central axis Cb and which is parallel to the Z axis and the X axis. That is, the plane CXb is a plane which passes through the center of the length along the Y axis of the ink supply section 280*b* and is orthogonal to the Y axis. In the explanation of the present embodiment, a reference numeral "CX" is used in cases where both of the plane CXa and the plane CXb are being referred to.

As shown in FIG. 7 to FIG. 14, the cartridge 20 is provided with an outer shell 200 with a cuboid as a basis. The cartridge 20 has a first surface 201, a second surface 202, a third surface 203, a fourth surface 204, a fifth surface 205, and a sixth surface 206 as six wall sections which configure the outer shell 200. In the present embodiment, the cartridge 20 has a seventh surface 207 and an eighth surface 208 along with the six of the first surface 201 to the sixth surface 206. As shown in FIG. 15, the ink containing section (printing material containing chamber) 300 is formed at the inner side of the first surface 201 to the eighth surface 208.

The first surface 201 to the eighth surface 208 are formed substantially as flat surfaces, it is not necessary for the entire area of the surface to be completely flat, and there may be bumps on a portion of the surface. In the present embodiment, the first surface 201 to the eighth surface 208 are the outer surfaces of an assembly which is assembled from a plurality of members.

In the present embodiment, comparing the length (length in the X axial direction), the width (length in the Y axial direction), and the height (length in the Z axial direction) of the cartridge 20 in terms of the size, the length is larger than the height, and the height is larger than the width. It is possible to arbitrarily change the size relationship of the length, the width, and the height of the cartridge 20. For example, the height may be larger than the length, and the length may be larger than the width. Alternatively, the height, the length, and the width may be the same.

The first surface 201 and the second surface 202 of the cartridge 20 are surfaces which are parallel to the X axis and the Y axis and have a positional relationship so as to oppose each other in the Z axial direction. The first surface 201 is positioned on the −Z axial direction side and the second surface 202 is positioned on the +Z axial direction side. The first surface 201 and the second surface 202 have a positional relationship so as to intersect with the third surface 203, the fourth surface 204, the fifth surface 205, and the sixth surface 206. Here, in this specification, the "intersecting" of two surfaces means any of a state where two surfaces intersect by being linked to each other, a state where an extended surface of one of the surfaces intersects with the other surface, and a state where extended surfaces intersect with each other. In the present embodiment, the first surface 201 configures the bottom surface of the cartridge 20 and the second surface 202 configures the upper surface of the cartridge 20 in the mounting state where the cartridge 20 is mounted in the holder 60.

As shown in FIG. 7 and FIG. 9, the two ink supply sections 280 are formed in the first surface 201. Each of the two ink supply sections 280 protrudes from the first surface 201 in the −Z axial direction. As shown in FIG. 7, each of the two ink supply sections 280 has an opening end 288 in an end portion (an end portion on the −Z axial direction side). The opening end 288 has an opening 286 and a partition end section 287 which defines the opening 286. The opening 286 is formed in a surface which is parallel to the X axis and the Y axis. In the explanation of the present embodiment, a reference numeral "288" is used in cases where both of the opening ends of the ink supply sections 280 are being referred to, a reference numeral "288*a*" is used in cases indicating the opening end of the ink supply section 280*a*, and a reference numeral "288*b*" is used in cases indicating the opening end of the ink supply section 280*b*.

In the present embodiment, the opening ends 288 of the ink supply sections 280 are sealed by a sealing member (not shown) such as a cap or a film during shipping of the cartridge 20 from the factory. After this, the sealing member (not shown) which seals the opening end 288 is removed from the cartridge 20 during mounting of the cartridge 20 with regard to the holder 60.

In the present embodiment, as shown in FIG. 9, the leakage preventing members 284 are provided in an inner side in the +Z axial direction side from the opening ends 288 at the inner side of the ink supply sections 280. In the present embodiment, as shown in FIG. 15, the leakage preventing member 284 includes a porous member 284*f* and a porous sheet member 284*s* made of synthetic resin (for example, polyethylene terephthalate). In the explanation of the present embodiment, the leakage preventing member "284" is used in cases where the leakage preventing members of the ink supply sections 280 are being referred to, a reference numeral "284*a*" is used in cases indicating the leakage preventing member of the ink supply section 280*a*, and a reference numeral "284*b*" is used in cases indicating the leakage preventing member of the ink supply section 280*b*. The sheet member 284*s* defines a flow path, through which the ink flows toward the opening end 288 of the ink supply section 280. With the flow direction of ink from the ink containing section 300 to the opening end 288 as a reference, an upstream side portion of the ink supply section 280 which includes the sheet member 284*s* is filled with ink. The sheet member 284*s* can form meniscus of ink. The sheet member 284*s* serves as an ink exit (printing material exit) through which the ink flows to the outside. Therefore, the sheet member 284*s* is also referred to as the printing material exit 284*s*.

As shown in FIG. 7, an end side of an opening path is provided inside the ink supply section 280, and the opening path connects the outside and the inside of the ink supply section 280 (specifically, a downstream side portion of the ink supply section 280 with respect to the sheet member 284*s*). An inner path 33 is located in the end side of the opening path, and the inner path 33 has a communicating port 32 formed in the end thereof.

In the present embodiment, the ink supply sections 280 of the cartridge 20 protrude in the −Z axial direction with the central axis C of the ink supply pipe 640 in the holder 60 as the center, but in other embodiments, the center of the ink supply section 280 may deviate from the central axis C of the ink supply pipe 640. In the present embodiment, the opening ends 288 of the ink supply sections 280 viewed from the −Z axial direction to the +Z axial direction has line symmetrical contours with regard to axes which are respectively parallel to the X axis and the Y axis, but in other embodiments, there may be contours which are not symmetrical. In the present embodiment, the shape of the opening end 288 viewed from the Z axial direction is a shape where the corners of a rectangle have been rounded as shown in FIG. 9, but in other embodiments, it may be a shape such as a circle, an ellipse, an oval, a square, or a rectangle.

As shown in FIG. 7, FIG. 9, FIG. 13, and FIG. 14, a groove section 240 is provided between the two ink supply sections 280 in the first surface 201 in a position which corresponds to the partition plate 607 in the holder 60. As shown by the dashed line in FIG. 13 and FIG. 14, the groove section 240 is provided to be concave closer to the +Z axial direction side than the first surface 201 and is configured so that it is possible for insertion of the partition plate 607 to be received in a state where the ink supply sections 280 are connected to the ink supply pipe 640. The length of the groove section 240 along the X axis is larger than the length of the partition plate 607 along the X axis. The length of the groove section 240 along the Y axis is larger than the length of the partition plate 607 along the Y axis.

As shown in FIG. 7 and FIG. 9, an optical detection element 270 is provided in the first surface 201 in a position which cuts across the plane CXa. The detection element 270 is a structure which is configured so that it is possible to optically detect ink in the ink containing section 300 from the outside of the cartridge 20. As shown in FIG. 15, in the present embodiment, the detection element 270 includes a prism 275 which is arranged to be able to come into contact with the ink which is contained in the ink containing section 300.

The third surface 203 and the fourth surface 204 of the cartridge 20 are surfaces which are parallel to the Y axis and the Z axis and have a positional relationship so as to oppose each other in the X axial direction. The third surface 203 is positioned on the +X axial direction side and the fourth surface 204 is positioned on the −X axial direction side. The third surface 203 and the fourth surface 204 have a positional relationship so as to intersect with the first surface 201, the second surface 202, the fifth surface 205, and the sixth surface 206. In the present embodiment, the third surface 203 configures the front surface of the cartridge 20 and the fourth surface 204 configures the rear surface of the cartridge 20 in the mounting state where the cartridge 20 is mounted in the holder 60.

As shown in FIG. 7 and FIG. 11, the substrate side fastening section 210 is formed in the third surface 203 in a position which cuts across the plane CXa. The substrate side fastening section 210 is provided closer to the +Z axial direction side and the +X axial direction side than the ink supply section 280 and the circuit substrate 40. The substrate side fastening section 210 has a fastening surface 211 which faces the +Z axial direction and is configured to be able to limit movement of the cartridge 20 in the +Z axial direction by the terminal platform side fastening section 810 which is positioned at the first fastening location 810L being fastened to the fastening surface 211 due to the rotation of the lever 80.

In the present embodiment, the substrate side fastening section 210 has a fastening surface 212 which faces the +X axial direction in addition to the fastening surface 211 which faces the +Z axial direction and is configured to be able to limit the movement of the cartridge 20 in the +Z axial direction and the +X axial direction by the terminal platform side fastening section 810 which is positioned at the first fastening position 810L being fastened to the fastening surface 211 and the fastening surface 212 due to the rotation of the lever 80. Consequently, it is possible to maintain the cartridge 20 in the designed mounting position in a more stable state.

In the present embodiment, the substrate side fastening section 210 is a convex section which protrudes from the third surface 203 in the +X axial direction. Consequently, it is possible to easily form the substrate side fastening section 210 in the third surface 203. In addition, it is possible for the user to easily identify the substrate side fastening section 210 during mounting of the cartridge 20.

In the present embodiment, the substrate side fastening section 210 is provided closer to an edge 203*mz* on the −Z axial direction side in the third surface 203 than an edge 203*pz* on the +Z axial direction side in the third surface 203. In the present embodiment, due to the −Z axial direction side of the substrate side fastening section 210 being adjacent to the edge 203*mz* on the −Z axial direction side of the third surface 203, there is an adjacent positional relationship even with regard to the circuit substrate 40 which is provided in the eighth surface. In other embodiments, the substrate side fastening section 210 may be separated from the edge 203*mz* on the −Z axial direction side of the third surface 203 and may be closer to the edge 203*pz* on the +Z axial direction side of the third surface 203.

In the present embodiment, the substrate side fastening section 210 has a part 215, a part 217, and a part 219 as shown in FIG. 7 and FIG. 11. The part 215 is formed in a shape which is linked to the −Z axial direction side of the part 217 and rises toward the part 217 from the third surface 203 and toward the +X axial direction side while heading toward the +Z axial direction. The part 217 is formed in a convex shape which interests with the plane CXa and which rises towards the +X axial direction from the third surface. The part 219 is formed in a convex shape which is linked to the +Z axial direction side of the part 217 and rises toward the +X axial direction side from the third surface 203. In the present embodiment, the substrate side fastening section 210 is a convex section in the shape of a letter L which protrudes from the third surface 203 with an L shape where the two sides are respectively parallel to the Y axis and the Z axis, the part 217 configures a part which is parallel to the Y axis of the convex section with the L shape, and the part 219 configures a part which is parallel to the Z axis of the convex section with the L shape.

In the present embodiment, the fastening surface 211 of the substrate side fastening section 210 is formed as a plane which faces the +Z axial direction in the part 217. That is, the fastening surface 211 is a plane which is parallel to the X axis and the Y axis. In the present embodiment, the fastening surface 212 of the substrate side fastening section 210 is formed as a plane which faces the +X axial direction in the part 217. That is, the fastening surface 212 is a plane which is parallel to the Y axis and the Z axis.

In the present embodiment, since the substrate side fastening section 210 has the part 215 adjacent in the −Z axial direction side of the part 217 where the fastening surface 211 is formed, it is possible to smoothly lead the terminal platform side fastening section 810 in the holder 60 toward the fastening surface 211 of the substrate side fastening section 210 when the cartridge 20 is mounted in the holder 60.

In the present embodiment, since the substrate side fastening section 210 has the part 219 adjacent in the +Z axial direction side of the part 217 where the fastening surface 211 is formed, it is possible to prevent the lever 80 from riding up on top of the +Z axial direction side of the fastening surface 211 when the cartridge 20 is mounted in the holder 60.

In the present embodiment, a protruding section 260 is formed in the third surface 203. The protruding section 260 is formed in a shape where the second surface 202 extends in the +X axial direction and protrudes from the third surface 203 in the +X axial direction. Since the protruding section 260 is formed in the cartridge 20, it is possible to easily perform lifting of the cartridge 20 in the +Z axial direction with the supply section side fastening section 220 as the rotation pivot by a user hooking a finger which presses the operation section 830 of the lever 80 toward the −X axial direction side as it is in the protruding section 260 when the cartridge 20 is removed from the holder 60. In other embodiments, the protruding section 260 may be omitted from the third surface 203.

As shown in FIG. 8, FIG. 9, and FIG. 12, the supply section side fastening section 220 is provided in the fourth surface 204 in a position which cuts across the plane CXa. The supply section side fastening section 220 is provided closer to the +Z axial direction side and the −X axial direction side than the ink supply section 280 and the circuit substrate 40. The supply section side fastening section 220 has a fastening surface 222 which faces the +Z axial direction and is configured to be able to limit movement of the cartridge 20 in the +Z axial direction by the supply pipe side fastening section 620 in the holder 60 being fastened to the fastening surface 222.

As shown in FIG. 8, FIG. 9, and FIG. 12, the supply section side fastening section 230 is provided in the fourth surface 204 in a position which cuts across the plane CXb. The supply section side fastening section 230 is provided closer to the +Z axial direction side and the −X axial direction side than the ink supply section 280 and the circuit substrate 40. The supply section side fastening section 230 has a fastening surface 232 which faces the +Z axial direction and is configured to be able to limit movement of the cartridge 20 in the +Z axial direction by the supply pipe side fastening section 620 in the holder 60 being fastened to the fastening surface 232.

In the present embodiment, the supply section side fastening sections 220 and 230 are configured so as to function as the rotation pivot of the cartridge 20 with regard to the holder 60 by being engaged with the supply pipe side fastening section 620 when mounting the cartridge 20 with regard to the holder 60. Consequently, it is possible to easily perform attaching and detaching of the cartridge 20 with regard to the holder 60.

In the present embodiment, the supply section side fastening sections 220 and 230 are convex sections which protrude to the −X axial direction from the fourth surface 204. Consequently, it is possible to easily form the supply section side fastening sections 220 and 230 in the fourth surface 204. In addition, it is possible for the user to easily identify the supply section side fastening sections 220 and 230 when mounting the cartridge 20.

In the present embodiment, the fastening surface 222 of the supply section side fastening section 220 is formed as a flat surface facing the +Z axial direction which configures a convex section which protrudes to the −X axial direction from the fourth surface 204, and the fastening surface 232 of the supply section side fastening section 230 is formed as a flat surface facing the +Z axial direction which configures a convex section which protrudes to the −X axial direction from the fourth surface 204. That is, the fastening surfaces 222 and 223 are flat surfaces which are parallel to the X axis and the Y axis.

In the present embodiment, the supply section side fastening section 220 has an inclined surface 227 which is adjacent to the −X axial direction side of the fastening surface 222 and the supply section side fastening section 230 has an inclined surface 237 which is adjacent to the −X axial direction side of the fastening surface 232. The inclined surfaces 227 and 237 are inclined toward the +Z axial direction and the −X axial direction. Consequently, it is possible to smoothly lead the fastening surfaces 222 and 232 toward the supply pipe side fastening section 620 in the holder 60 when the cartridge 20 is mounted in the holder 60. In other embodiments, the inclined surfaces 227 and 237 may be omitted.

The fifth surface 205 and the sixth surface 206 of the cartridge 20 are surfaces which are parallel to the Z axis and the X axis and have a positional relationship so as to oppose each other in the Y axial direction. The fifth surface 205 is positioned on the +Y axial direction side and the sixth surface 206 is positioned on the −Y axial direction side. The fifth surface 205 and the sixth surface 206 have a positional relationship so as to intersect with the first surface 201, the second surface 202, the third surface 203, and the fourth surface 204. In the present embodiment, the fifth surface 205 configures the left side surface of the cartridge 20 and the sixth surface 206 configures the right side surface of the cartridge 20 in the mounting state where the cartridge 20 is mounted in the holder 60.

As shown in FIG. 8 and FIG. 13, an air introduction port 209 is provided in the fifth surface 205. The air introduction port 209 connects to a space in the inside of the outer shell 200. In the present embodiment, air, which is introduced from the air introduction port 209, is introduced into the ink containing section 300 at a predetermined timing according to the consumption state of the ink in the ink containing section 300. In other embodiments, air, which is introduced from the air introduction port 209, may be introduced into the ink containing section 300 as required in accordance with decreases in the ink in the ink containing section 300. Furthermore, in other embodiments, the ink containing section 300 may be a closed space where air is not introduced. In the present embodiment, the air introduction port 209 configures an end of the opening path to connect the outside and the inside of the ink supply section 280 (specifically, the downstream side portion of the ink supply section 280 with respect to the sheet member 284*s*). The other end of the opening path is the communicating port 32 which is provided inside the ink supply section 280 (FIG. 7).

As shown in FIG. 7, the seventh surface 207 of the cartridge 20 is configured as a corner portion which connects between the first surface 201 and the third surface 203 along with the eighth surface 208. The seventh surface 207 includes a seventh surface 207*a* which is provided closer to the +Y axial direction and a seventh surface 207*b* which is provided closer to the −Y axial direction. In the explanation of the present embodiment, a reference numeral "207" is used in cases where both the seventh surface 207*a* and the seventh surface 207*b* are being referred to.

The seventh surface 207 is a surface which is formed to extend from the first surface 201 to the +Z axial direction side, links with the eighth surface 208 on the +Z axial direction side, and links with the first surface 201 on the −Z axial direction side. In the present embodiment, the seventh surface 207 is a surface which is parallel to the Y axis and the Z axis and has a positional relationship which opposes the fourth surface 204.

As shown in FIG. 7, the eighth surface 208 of the cartridge 20 is configured as a corner portion which connects between the first surface 201 and the third surface 203 along with the seventh surface 207. The eighth surface 208 includes an eighth surface 208*a* which is provided closer to the +Y axial direction and an eighth surface 208*b* which is provided closer to the −Y axial direction. In the explanation of the present embodiment, a reference numeral "208" is used in cases where both the eighth surface 208*a* and the eighth surface 208*b* are being referred to.

The eighth surface 208 is a surface which is formed closer to the +Z axial direction side than the seventh surface 207, links with the third surface 203 on the +Z axial direction side, and links with the seventh surface 207 on the −Z axial direction side. In the present embodiment, the eighth surface 208 is inclined toward the −Z axial direction and the +X axial direction as shown in FIG. 7, FIG. 13, and FIG. 14. That is, the eighth surface is an inclined surface which links between the first surface 201 and the third surface 203 by being inclined with regard to the first surface 201 and the third surface 203.

As shown in FIG. 9, the circuit substrate 40 is provided in a position which cuts across the plane CXa. As shown in FIG. 7 and FIG. 13, the circuit substrate 40 has a cartridge side inclined surface 408. The cartridge side inclined surface 408 is inclined towards the −Z axial direction and the +X axial direction with regard to the first surface 201 and the third surface 203 in a state of being arranged in the eighth surface 208. The cartridge side terminals 430 are provided in the cartridge side inclined surface 408 and the cartridge side terminals 430 on the circuit substrate 40 in the cartridge 20 come into contact with the device side terminals 730 on the terminal platform 70 in the holder 60 in a state where the cartridge 20 is mounted in the holder 60.

It is preferable for an angle ϕ where the cartridge side inclined surface 408 is inclined with regard to a flat surface which is parallel to the X axis and the Y axis (for example, the flat surface where the opening end 288 of the ink supply section 280 is positioned) to be 25° to 40° as shown in FIG. 13. By the angle of the cartridge side inclined surface 408 being 25° or more, it is possible to secure a sufficient wiping amount. Wiping is scrapping of the cartridge side terminals 430 on the cartridge side inclined surface 408 using the device side terminals 730 on the terminal platform 70 when the cartridge 20 is mounted in the holder 60. The wiping amount is a length where it is possible for the cartridge side terminals 430 to scrap the device side terminals 730. Due to the wiping, it is possible to remove dust and dirt which has become attached onto the cartridge side terminals 430 and reduce connection defects between the cartridge side terminals 430 and the device side terminals 730. By the angle of the cartridge side inclined surface 408 being 40° or less, it is possible to secure sufficient components in the +Z axial direction which are included in the pressing force Pt with regard to the circuit substrate 40 from the device side terminals 730 which are provided in the terminal platform 70.

In the present embodiment, substrate side engaging sections 252 and 254 are provided in the seventh surface of the cartridge 20 as shown in FIG. 7, FIG. 9, and FIG. 11. The substrate side engaging section 252 of the cartridge 20 is provided to extend toward the +X axial direction of the seventh surface 207 closer to the +Y axial direction and the substrate side engaging section 254 of the cartridge 20 is provided to extend toward the +X axial direction of the seventh surface 207 closer to the −Y axial direction. The substrate side engaging sections 252 and 254 face each other on an axis which is parallel to the Y axis on the −Z axial direction side of the circuit substrate 40 and are configured to be able to engage with an engaging section 665 in a state where the engaging section 665 is interposed between the substrate side engaging section 252 and the substrate side engaging section 254 in the holder 60 shown in FIG. 4. Consequently, it is possible to prevent positional deviation of the circuit substrate 40 with regard to the holder 60 in the X axial direction and the Y axial direction and it is possible for the cartridge side terminals 430 to come into contact with the device side terminals 730 at the correct position. In the present embodiment, the length of the substrate side engaging section 252 along the Y axis is different from the length of the substrate side engaging section 254 along the Y axis in order to prevent erroneous mounting of the cartridge 20 with regard to the holder 60.

In the present embodiment, supply section side engaging sections 256 and 258 are provided in the first surface of the cartridge 20 as shown in FIG. 7, FIG. 9, and FIG. 12. The supply section side engaging section 256 is provided to extend from the first surface which faces the −Z axial direction to be adjacent to the −X axial direction side of the ink supply section 280 closer to the +Y axial direction, and the supply section side fastening section 258 is provided to extend from the first surface which faces the −Z axial direction to be adjacent to the −X axial direction side of the ink supply section 280 closer to the −Y axial direction. The supply section side engaging sections 256 and 258 are configured to be able to engage with engaging sections (not shown) in the holder 60. Consequently, it is possible to prevent positional deviation of the ink supply section 280 with regard to the holder 60 in the X axial direction and the Y axial direction and it is possible to connect the ink supply section 280 to the ink supply pipe 640 at the correct position. In the present embodiment, the length of the supply section side engaging section 256 along the Y axis is different from the length of the supply section side fastening section 258 along the Y axis in order to prevent erroneous mounting of the cartridge 20 with regard to the holder 60. In the explanation of the present embodiment, reference numerals "256 and 258" are used in cases where both of the supply section side engaging sections are being referred to, reference numerals "256*a* and 258*a*" are used in cases indicating the supply section side engaging section which is adjacent to the ink supply section 280*a*, and reference numerals "256*b* and 258*b*" are used in cases indicating the supply section side engaging section which is adjacent to the ink supply section 280*b*.

In the present embodiment, a substrate side surface engaging section 262 which has a flat surface which is parallel to the Z axis and the Y axis toward the +Y axial direction is provided in the vicinity of the +Y axial direction side of the circuit substrate 40 and a substrate side surface engaging section 264 which has a flat surface which is parallel to the Z axis and the Y axis toward the −Y axial direction is provided in the vicinity of the −Y axial direction side of the circuit substrate 40 in the cartridge 20 as shown in FIG. 7 and FIG. 11. The substrate side surface engaging sections 262 and 264 are configured to be able to engage with the engaging sections 662 and 664 in the holder 60 shown in FIG. 4. Consequently, it is possible to prevent positional deviation of the circuit substrate 40 with regard to the holder 60 in the X axial direction and the Y axial direction, and it is possible for the cartridge side terminals 430 to come into contact with the device side terminals 730 at the correct position.

In the present embodiment, a substrate side engaging section 266 which has a flat surface which is parallel to the Z axis and the Y axis toward the +Y axial direction is further provided on the +Y axial direction side of the substrate side surface engaging section 262 and a substrate side engaging section 268 which has a flat surface which is parallel to the Z axis and the Y axis toward the −Y axial direction is further provided on the −Y axial direction side of the substrate side surface engaging section 264 as shown in FIG. 7 and FIG. 11. The substrate side engaging sections 266 and 268 are configured to be able to engage with the fastening sections 666 and 668 in the holder 60 shown in FIG. 4. Consequently, it is possible to prevent positional deviation of the circuit substrate 40 with regard to the holder 60 in the X axial direction and the Y axial direction, and it is possible for the cartridge side terminals 430 to come into contact with the device side terminals 730 at the correct position.

As shown in FIG. 15 and FIG. 16, the cartridge 20 has a main body member 301, a left side surface member 305, and a right side surface member 306 as members which configure the outer shell 200. The cartridge 20 has film members 335, 361, and 386 in addition to the main body member 301 as members which define the ink containing section 300. The cartridge 20 further has valve members 322, 324, a plate member 325, and elastic members 326, 328 as members which adjust the internal pressure of the ink containing section 300.

As shown in FIG. 15 and FIG. 16, the cartridge 20 has an inner connecting chamber 352 which penetrates the main body member 301 in the Y axial direction. The inner connecting chamber 352 configures a part of the opening path, and leads to two inner paths 33*a*, 33*b* (FIG. 7). The inner connecting chamber 352 leads to an air chamber, formed between the film member 335 and the left side surface member 305, in which no ink is contained. The air chamber leads to the air introduction port 209.

Figure 17:
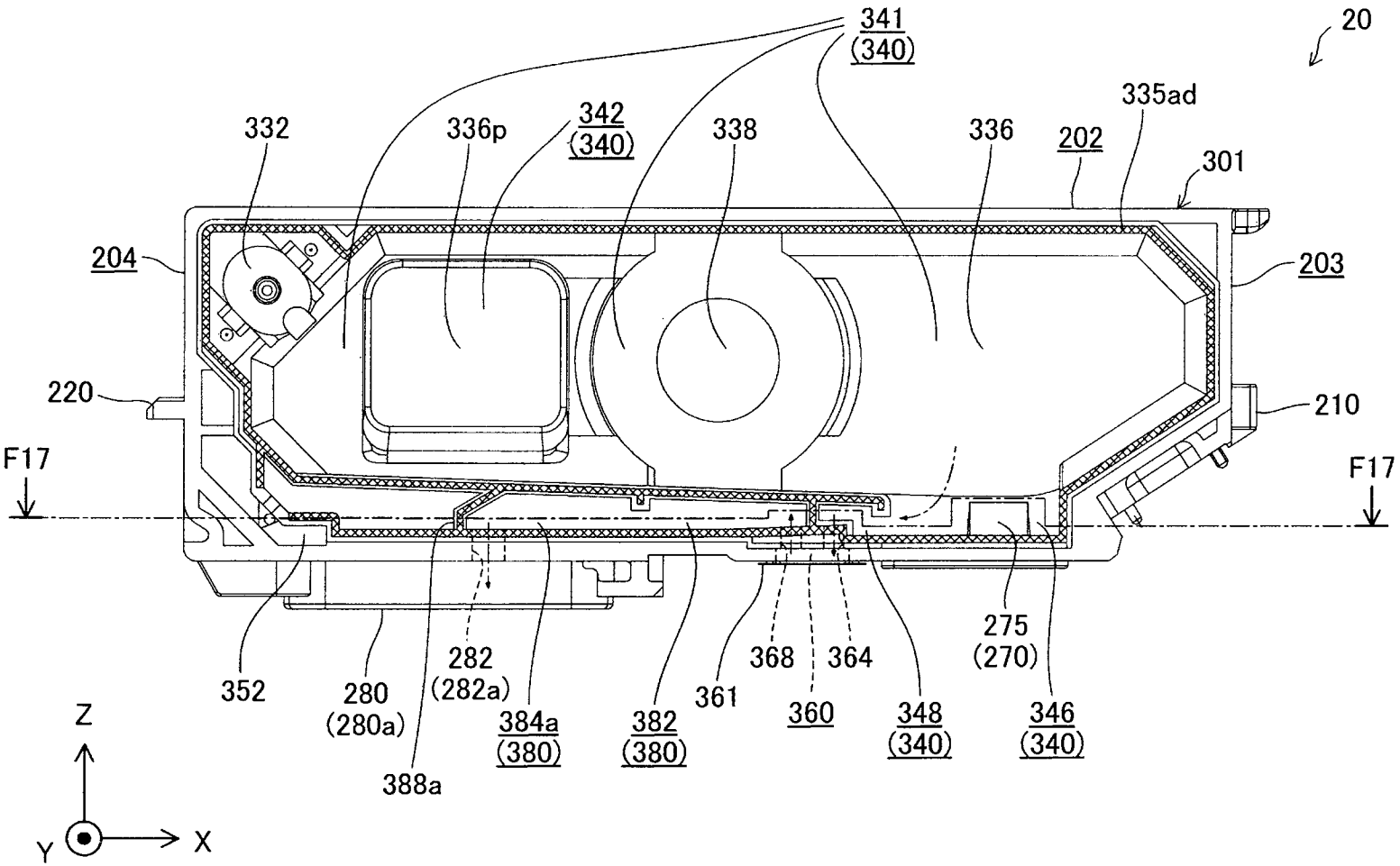
FIG. 17 is a left side surface diagram illustrating a configuration of a main body member of a cartridge.
Figure 18:
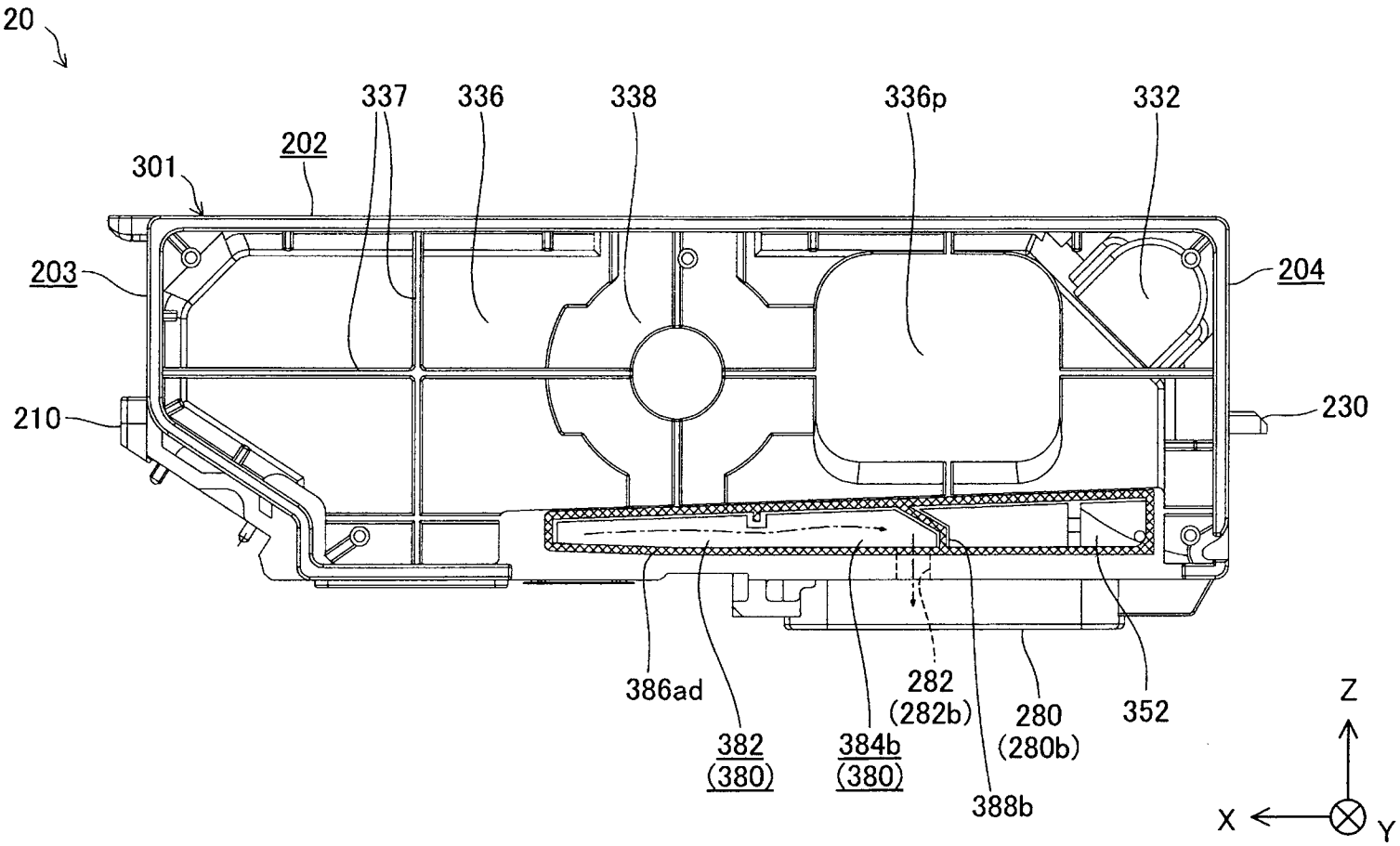
FIG. 18 is a right side surface diagram illustrating a configuration of a main body member of a cartridge.
Figure 19:
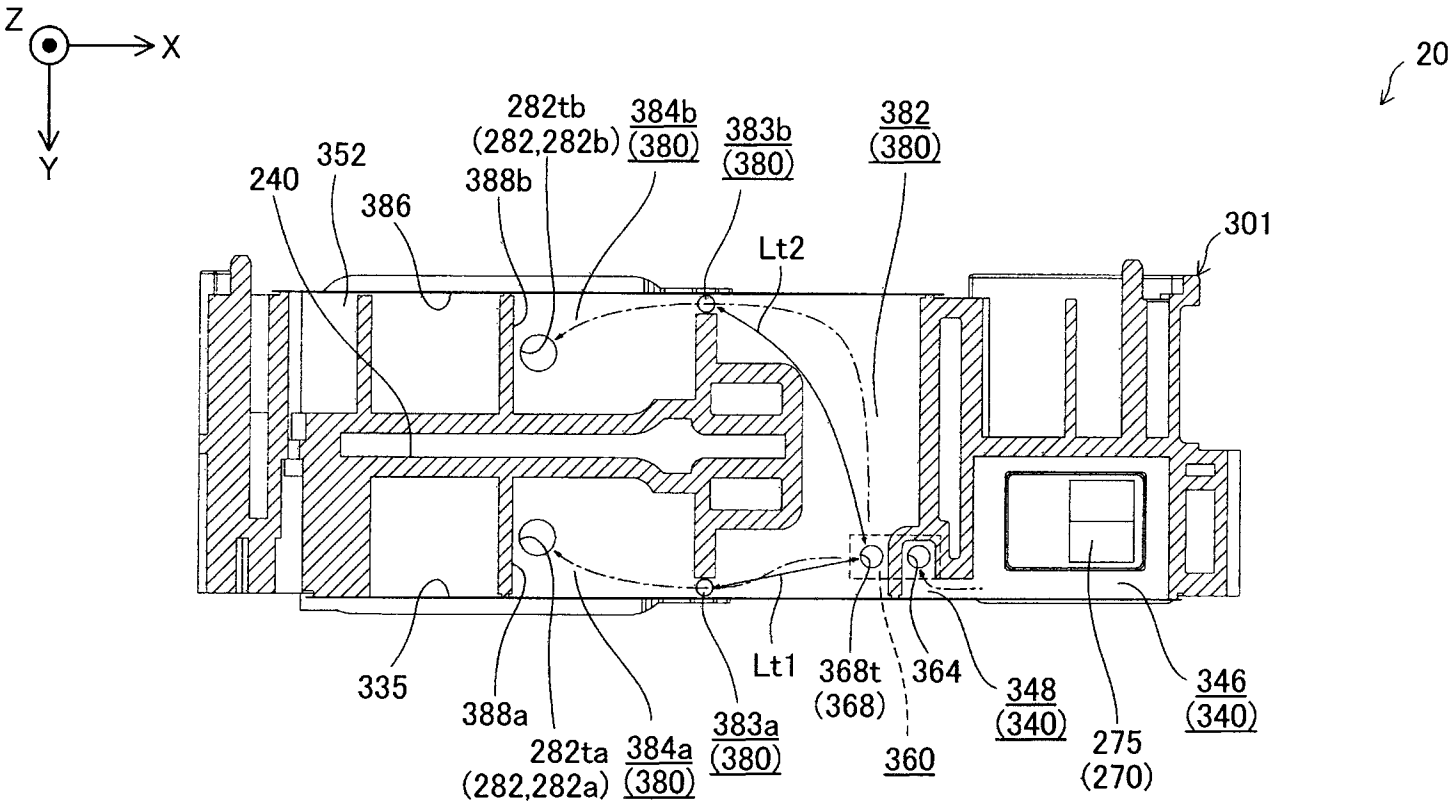
FIG. 19 is a cross-sectional diagram of F17-F17 in FIG. 17.

FIG. 17 is a left side surface diagram illustrating the configuration of the main body member 301 of the cartridge 20. FIG. 18 is a right side surface diagram illustrating the configuration of the main body member 301 of the cartridge 20. FIG. 19 is a cross-sectional diagram illustrating the cartridge 20 cut in a position corresponding to an arrow F17-F17 in FIG. 17. As shown in FIG. 17 to FIG. 19, the cartridge 20 has a main ink chamber 340 and a sub ink chamber 380 as parts which configure the ink containing section 300. The main ink chamber 340 and the sub ink chamber 380 are connected by a connecting path 360, and a slight amount of ink is contained also in the connecting path 360.

As shown in FIG. 15 to FIG. 19, in the present embodiment, the main body member 301 of the cartridge 20 is a member which is obtained by integrally forming structures such as the first surface 201, the second surface 202, the third surface 203, the fourth surface 204, the substrate side fastening section 210, the supply section side fastening sections 220, 230, the protruding section 260, the ink supply section 280, and the like. In addition to these structures, the main body member 301 has a valve containing section 332, an intermediate wall 336, and peripheral convex sections 335*ad*, 386*ad*. In the present embodiment, the main body member 301 is made of synthetic resin (for example, polypropylene (PP) or polyacetal (POM)).

As shown in FIG. 17, the valve containing section 332 of the main body member 301 is provided in the main ink chamber 340, and contains the valve members 322, 324, and the elastic member 326. In the present embodiment, the valve containing section 332 is provided on the +Z axial direction side and the −X axial direction side in the main ink chamber 340.

As shown in FIG. 15, the intermediate wall 336 of the main body member 301 is a wall section which defines the −Y axial direction side of the ink containing section 300 along the Z axis and the X axis. In the present embodiment, the intermediate wall 336 has a protruding section 336*p* a part of which protrudes toward the −Y axial direction. In the present embodiment, the intermediate wall 336 has a retaining section 338 which retains the elastic member 328. As shown in FIG. 16, in the present embodiment, a reinforcing plate 337 for reinforcing the main body member 301 is formed on the −Y axial direction side of the intermediate wall 336.

As shown in FIG. 15, the peripheral convex section 335*ad* of the main body member 301 is provided in the periphery of a part of the ink containing section 300 open to the +Y axial direction in the main body member 301, and has a convex shape in the +Y axial direction. In FIG. 17, the peripheral convex section 335*ad* is illustrated with cross-hatching. The film member 335 is attached to the peripheral convex section 335*ad* in a closed state.

As shown in FIG. 16, the peripheral convex section 386*ad* of the main body member 301 is provided in the periphery of a part of the ink containing section 300 open to the −Y axial direction in the main body member 301, and has a convex shape in the −Y axial direction. In FIG. 18, the peripheral convex section 386*ad* is illustrated with cross-hatching. The film member 386 is attached to the peripheral convex section 386*ad* in a closed state.

As shown in FIG. 15, in the present embodiment, the left side surface member 305 of the cartridge 20 is a member which is obtained by integrally forming structures such as the fifth surface 205, the air introduction port 209, and the like. The left side surface member 305 is attached to the main body member 301 so as to cover the film member 335. In the present embodiment, similarly to the main body member 301, the left side surface member 305 is made of synthetic resin (for example, polypropylene or polyacetal). In the present embodiment, the left side surface member 305 is attached to the +Y axial direction side of the main body member 301 by heat adhesion.

As shown in FIG. 16, in the present embodiment, the right side surface member 306 of the cartridge 20 is a member which is obtained by integrally forming structures such as the sixth surface 206 and the like. The right side surface member 306 is attached to the main body member 301 so as to cover the film member 386. In the present embodiment, similarly to the main body member 301, the right side surface member 306 is made of synthetic resin (for example, polypropylene or polyacetal). In the present embodiment, the right side surface member 306 is attached to the −Y axial direction side of the main body member 301 by heat adhesion.

The film member 335 of the cartridge 20 is a thin film which has ink impermeability, air tightness, and flexibility. As shown in FIG. 15 and FIG. 17, the film member 335 is attached to the peripheral convex section 335*ad* of the main body member 301 in a closed state, and defines the +Y axial direction side in each ink containing chamber of the main ink chamber 340 and the sub ink chamber 380. In the present embodiment, the film member 335 is made of synthetic resin (for example, a composite material of nylon and polypropylene).

The valve member 322 of the cartridge 20 is a valve body which has a through hole 322H. The valve member 322 is attached to the valve containing section 332 of the main body member 301 in a state where the +Y axial direction side thereof is attached to the film member 335. The through hole 322H of the valve member 322 connects to the air introduction port 209 via a through hole 335H of the film member 335. In the present embodiment, the valve member 322 is made of synthetic resin (for example, polypropylene).

The valve member 324 of the cartridge 20 is pressed against the valve member 322 by the elastic member 326 so as to close the through hole 322H of the valve member 322. The valve member 324 opens the through hole 322H of the valve member 322 depending on the position of the plate member 325 in the main ink chamber 340. In the present embodiment, the valve member 324 is made of synthetic resin (for example, polypropylene). In the present embodiment, the elastic member 326 is a coil spring made of metal.

As shown in FIG. 15, the plate member 325 of the cartridge 20 is a plate-shaped member which abuts against the film member 335 in a state of being biased by the elastic member 328 in a direction of expanding the volume of the main ink chamber 340 inside the main ink chamber 340. The plate member 325 is displaced together with the film member 335 in response to the internal pressure of the main ink chamber 340, and in the present embodiment, the plate member 325 is displaced along the Y axis. In the present embodiment, the plate member 325 is made of synthetic resin (for example, polypropylene) or metal (stainless steel).

The elastic member 328 of the cartridge 20 presses the plate member 325 against the film member 335 inside the main ink chamber 340. That is, the elastic member 328 biases the plate member 325 in a direction of expanding the volume of the main ink chamber 340. In this manner, the elastic member 328 configures the negative pressure generating member which generates negative pressure in the main ink chamber 340 in cooperation with the plate member 325. The elastic member 328 expands and contracts in response to the internal pressure of the main ink chamber 340, and in the present embodiment, the elastic member 328 expands and contracts along the Y axis. In the present embodiment, the elastic member 328 is attached to the retaining section 338 of the main body member 301 and connected with the plate member 325.

In the present embodiment, the elastic member 328 is a coil spring made of metal. In FIG. 15, the elastic member 328 as a coil spring is schematically illustrated. The elastic member 328 is not limited to a coil spring made of metal, and it is sufficient for the elastic member 328 to be made of a material which can generate negative pressure in the main ink chamber 340. For example, the elastic member 238 may be another type of spring made of metal, a spring made of synthetic resin, a rubber member, a fluid spring, a continuous porous member (for example, polyurethane foam), or the like.

The film member 361 of the cartridge 20 is a thin film which has ink impermeability and air tightness. As shown in FIG. 9 and FIG. 17, the film member 361 is attached to the −Z axial direction side of the main body member 301 in a closed state, and defines the −Z axial direction side in the connecting path 360. In the present embodiment, the film member 361 is made of synthetic resin (for example, a composite material of nylon and polypropylene).

The film member 386 of the cartridge 20 is a thin film which has ink impermeability and air tightness. As shown in FIG. 16 and FIG. 18, the film member 386 is attached to the peripheral convex section 386*ad* of the main body member 301 in a closed state, and defines the −Y axial direction side in the sub ink chamber 380. In the present embodiment, the film member 386 is made of synthetic resin (for example, a composite material of nylon and polypropylene).

As shown in FIG. 17 and FIG. 19, the main ink chamber 340 forms a space which can contain ink in the cartridge 20. In the present embodiment, the main ink chamber 340 is constructed of the main body member 301 and the film member 335. The main ink chamber 340 has a first region 341, a second region 342, a detection region 346, and a communicating path 348.

The first region 341 in the main ink chamber 340 is formed from the +X axial direction side to the −X axial direction side closer to the +Y axial direction between the fifth surface 205 and the sixth surface 206. As described above, the plate member 325 and the elastic member 328 are arranged in the first region 341 as the negative pressure generating member.

As shown in FIG. 16 and FIG. 17, the second region 342 in the main ink chamber 340 is formed by the protruding section 336*p* closer to the fourth surface 204 than the retaining section 338. As shown in FIG. 17, the second region 342 is adjacent to the first region 341, and has a shape in which a part of the first region 341 is expanded in the −Y axial direction.

As shown in FIG. 15 and FIG. 17, the film member 335 is a first defining plane which defines the first region 341 and the second region 342 on the fifth surface 205 side, and has a shape along the fifth surface 205 all over the first region 341 and the second region 342. The intermediate wall 336 is a second defining plane which defines the first region 341 and the second region 342 on the sixth surface 206 side, and has a shape in which a part of the intermediate wall 336 corresponding to the second region 342 protrudes toward the sixth surface 206.

The detection region 346 in the main ink chamber 340 is configured to be able to detect ink in the main ink chamber 340. As shown in FIG. 17, in the present embodiment, the prism 275 of the detection element 270 is provided in the detection region 346, and ink in the main ink chamber 340 can be detected using the detection element 270 as explained above. The detection region 346 is formed closer to the third surface 203 than the retaining section 338. The detection region 346 is adjacent to the first region 341 on the −Z axial direction side, and has a shape in which a part of the first region 341 is expanded in the −Z axial direction. The prism 275 has two surfaces which intersect substantially at a right angle. In the prism, the reflection state of light is different depending on the refractive index of fluid which contacts the two surfaces. The control section 510 of the printer 50 determines the presence or absence of ink in the cartridge using the prism 275.

The determination is made as follows based on exchange of light between the detection section 57 of the printer 50 shown in FIG. 1 and the prism 275 of the cartridge 20 shown in FIG. 17. First, light is emitted from the light emitting section of the detection section 57 toward one of the two surfaces of the prism 275. At this time, in a case where the vicinity of the prism 275 is filled with ink, most of light emitted from the light emitting section of the detection section 57 passes through the surface, and does not reach the light receiving section of the detection section 57. On the other hand, in a case where there is no ink in the vicinity of the prism 275, most of light emitted from the light emitting section is reflected on the surface of the prism 275. This reflected light is reflected on the other surface of the prism 275 toward the detection section 57, and reaches the light receiving section of the detection section 57. In this manner, in a case where the light receiving section of the detection section 57 does not detect light of a predetermined level or more, "the presence of ink" is determined in the control section 510 of the printer 50, and in a case where the light receiving section of the detection section 57 detects light of a predetermined level or more, "the absence of ink" is determined in the control section 510 of the printer 50. Here, the absence of ink includes a state where only little ink remains.

As shown in FIG. 17, the communicating path 348 in the main ink chamber 340 connects the detection region 346 and the connecting path 360. In the present embodiment, the communicating path 348 is adjacent to the detection region 346 on the −X axial direction side. In the present embodiment, the communicating path 348 proceeds from the detection region 346 in the −X axial direction, then rises by one step in the +Z axial direction with respect to the detection region 346 and proceeds in the −Y axial direction, and leads to the connecting path 360 on the −Z axial direction side via a through hole 364.

As shown in FIG. 9, FIG. 17 and FIG. 19, the connecting path 360 in the cartridge 20 forms a space which can contain a slight amount of ink, and connects the main ink chamber 340 and the sub ink chamber 380. In the present embodiment, the connecting path 360 is constructed of the main body member 301 and the film member 361. The connecting path 360 is provided on the −Z axial direction side with respect to the main ink chamber 340 and the sub ink chamber 380. The connecting path 360 leads to the main ink chamber 340 on the +Z axial direction side via the through hole 364, and leads to the sub ink chamber 380 on the +Z axial direction side via a through hole 368. Consequently, the connecting path 360 serves as a backflow preventing section which prevents backflow of ink from the sub ink chamber 380 to the detection region 346 in the main ink chamber 340.

As shown in FIG. 17 to FIG. 19, the sub ink chamber 380 in the cartridge 20 forms a space which can contain ink. As shown in FIG. 19, the sub ink chamber 380 is branched into each of the ink flow paths 282 to connect the main ink chamber 340 and the ink flow paths 282, so that the sub ink chamber 380 serves as a branch communicating section through which ink flows into each of the ink flow paths 282. In the explanation of the present embodiment, a reference numeral "282" is used in cases where the ink flow paths 282 are being referred to. A reference numeral "282*a*" is used in cases indicating the ink flow path which leads to the ink supply section 280*a* among the plurality of ink flow paths 282, and a reference numeral "282*b*" is used in cases indicating the ink flow path which leads to the ink supply section 280*b* among the plurality of ink flow paths 282.

In the present embodiment, the sub ink chamber 380 is constructed of the main body member 301, the film member 335, and the film member 386. As shown in FIG. 17, the sub ink chamber 380 is provided on the −Z axial direction side with respect to the first region 341 in the main ink chamber 340, on the −X axial direction side with respect to the detection region 346, and on the +Z axial direction side with respect to the connecting path 360.

As shown in FIG. 19, the sub ink chamber 380 has a region 382, a region 383*a*, a region 383*b*, a region 384*a*, and a region 384*b*. The through hole 368 is provided in the region 382. The ink flow path 282*a* is provided in the region 384*a*, and the ink flow path 282*b* is provided in the region 384*b*. The region 383*a* forms a flow path which is narrower than the region 382 and the region 384*a*, and connects the region 382 and the region 384*a*. The region 383*b* forms a flow path which is narrower than the region 382 and the region 384*b*, and connects the region 382 and the region 384*b*.

In the present embodiment, the −X axial direction side of the region 384*a* in the sub ink chamber 380 is defined by a bulkhead section 388*a* of the main body member 301, and the −X axial direction side of the region 384*b* in the sub ink chamber 380 is defined by a bulkhead section 388*b* of the main body member 301.

For example, as shown in FIG. 17 and FIG. 18, in the cartridge 20 of the present embodiment, the −X axial direction side of the regions 384*a*, 384*b* in the sub ink chamber 380 is defined by the bulkhead sections 388*a*, 388*b* of the main body member 301. In contrast to this, another cartridge in which the volume of the sub ink chamber 380 is expanded by removing the bulkhead sections 388*a*, 388*b* for a new lineup is assumed. In such a case, a basic mold common to the cartridge with no the bulkhead sections 388*a*, 388*b* and the cartridge 20 of the present embodiment is prepared, and a bush is added to a position which corresponds to a part of the bulkhead sections 388*a*, 388*b* in the basic mold for manufacturing the cartridge with no bulkhead sections 388*a*, 388*b*.

As shown by the arrow in FIG. 17 and FIG. 19, ink in the main ink chamber 340 flows from the detection region 346 to the communicating path 348, passes the through hole 364, and flows to the connecting path 360. As shown by the arrow in FIG. 17, ink in the connecting path 360 passes the through hole 368, and flows to the sub ink chamber 380. As shown by the arrow in FIG. 17 to FIG. 19, ink in the sub ink chamber 380 is branched from the region 382 into the region 384*a* and the region 384*b*. Ink in the region 384*a* passes the ink flow path 282*a*, and is supplied from the ink supply section 280*a* to the outside of the cartridge 20. Ink in the region 384*b* passes the ink flow path 282*b*, and is supplied from the ink supply section 280*b* to the outside of the cartridge 20.

Figure 20:
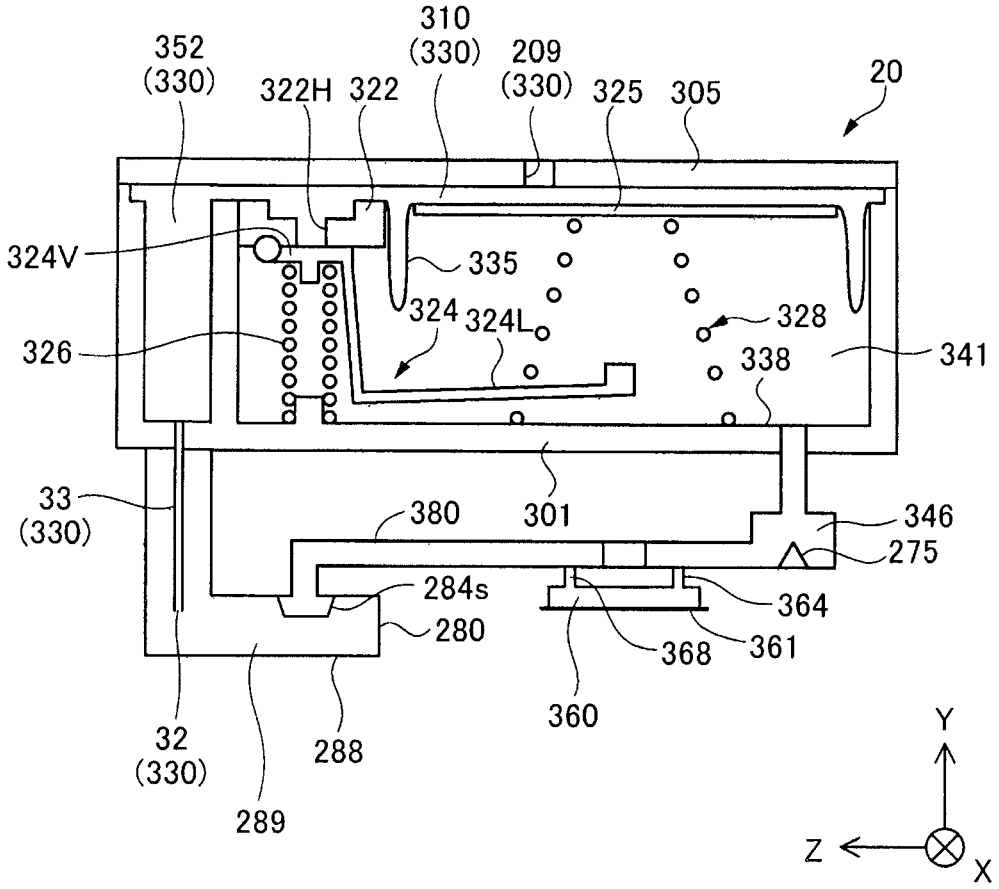
FIG. 20 is an explanatory diagram schematically illustrating a state of adjusting internal pressure of a cartridge.
Figure 21:
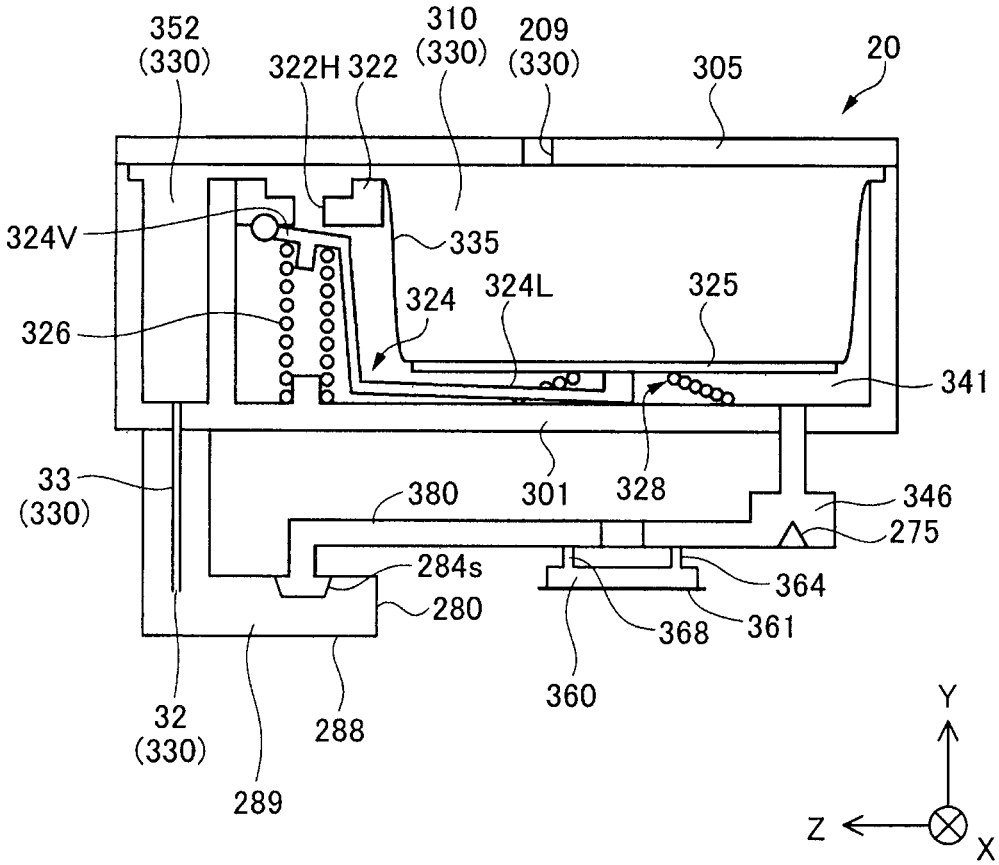
FIG. 21 is an explanatory diagram schematically illustrating a state of adjusting internal pressure of a cartridge.
Figure 22:
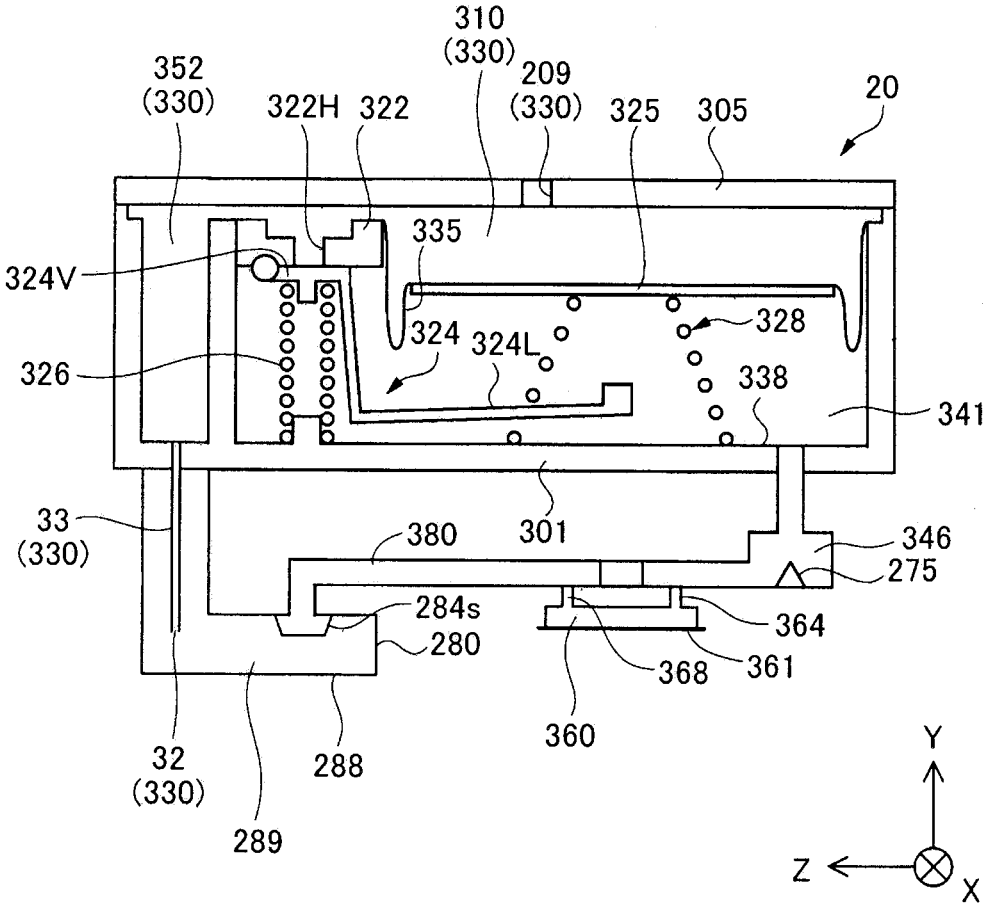
FIG. 22 is an explanatory diagram schematically illustrating a state of adjusting internal pressure of a cartridge.

FIG. 20, FIG. 21, and FIG. 22 are explanatory diagrams schematically illustrating a state of adjusting internal pressure of the cartridge 20. As shown in FIG. 20, in a state where the main ink chamber 340 is sufficiently filled with ink, a valve section 324V of the valve member 324 is biased against the valve member 322 by the elastic member 326 so as to block the through hole 322H of the valve member 322. In this state, the elastic member 328 biases the plate member 325 in a direction of expanding the volume of the main ink chamber 340 (the +Y axial direction). In this manner, the internal pressure of the main ink chamber 340 is maintained at pressure lower than atmospheric pressure (negative pressure).

As shown in FIG. 21, when the ink in the main ink chamber 340 is consumed and the internal pressure of the main ink chamber 340 becomes lower than that of the state of FIG. 20, the plate member 325 is displaced in the −Y axial direction together with the film member 335 so as to press a lever section 324L of the valve member 324 in the −Y axial direction. In response to this, the valve section 324V of the valve member 324 opens the through hole 322H of the valve member 322, and the main ink chamber 340 is temporarily connected with an air chamber 310 which is filled with air through the air introduction port 209. Consequently, air is flowed into the main ink chamber 340, and as shown in FIG. 22, the volume of the main ink chamber 340 becomes larger than that of the state of FIG. 21. In addition, the internal pressure of the main ink chamber 340 becomes closer to the atmospheric pressure compared to the state of FIG. 21. As shown in FIG. 22, when a certain amount of air is flowed into the main ink chamber 340, the plate member 325 is separated from the lever section 324L of the valve member 324 and the valve section 324V of the valve member 324 blocks the through hole 322H of the valve member 322 again. In this manner, the internal pressure of the cartridge 20 is maintained in an appropriate pressure range.

As schematically shown in FIG. 20 to FIG. 22, the cartridge 20 is provided with a communicating path 330 which connects the inside and the outside of the ink supply section 280. The communicating path is provided with the inner path 33 having the communicating port 32 in an end portion thereof, the inner connecting chamber 352, the air chamber 310 located between the film member 335 and the left side surface member 305, and the air introduction port 209. Here, as shown in FIG. 7, the communicating path 330 which connects the inside and the outside of the ink supply section 280*a* is also referred to as a first communicating path 330*a*, and the communicating path 330 which connects the inside and the outside of the ink supply section 280*b* is also referred to as a second communicating path 330*b*. Also, the inner path 33 which is provided inside the ink supply section 280*a* is also referred to as a first inner path 33*a*, and the inner path 33 which is provided inside the ink supply section 280*b* is also referred to as a second inner path 33*b*. Here, the first communicating path 330*a* and the second communicating path 330*b* share the inner connecting chamber 352, the air chamber 310, and the air introduction port 209. The inner path 33 is a flow path which is located on one end side of the communicating path 330.

Hereinafter, the above-described ink containing section 300 of the cartridge 20 will be described in more detail. The ink containing section 300 is provided with the main ink chamber 340, and the sub ink chamber 380 which branches ink contained in the main ink chamber 340 into the ink supply sections 280*a* and 280*b*. Also, as shown in FIG. 19, the ink containing section 300 is provided with first to third ports 368*t*, 282*ta*, and 282*tb*. The ink contained in the main ink chamber 340 flows into the sub ink chamber 380 through the first port 368*t*. The first port 368*t* is provided in the region 382. The first port 368*t* is an end portion of the through hole 368. The ink contained in the sub ink chamber 380 flows into the ink supply section 280*a* through the second port 282*ta*. The second port 282*ta* is provided in the region 384*a*. The second port 282*ta* is an end portion of the ink flow path 282*a*. The ink contained in the sub ink chamber 380 flows into the ink supply section 280*b* through the third port 282*tb*. The third port 282*tb* is provided in the region 384*b*. The third port 282*tb* is an end portion of the ink flow path 282*b*. Also, as shown in FIG. 19, a flow path length Lt2 from the first port 368*t* to the region 384*b* is longer than a flow path length Lt1 from the first port 368*t* to the region 384*a*. Here, the flow path lengths Lt1, Lt2 are the shortest distances between the elements.

Also, as shown in FIG. 15 and FIG. 19, the film member 335 is located on the +Y axial direction side of the cartridge 20. The film member 335 forms side surfaces on the +Y axial direction side of the main ink chamber 340, the region 382, and the region 384*a*.

Also, as shown in FIG. 16 and FIG. 19, the film member 386 is located on the −Y axial direction side of the cartridge 20. The film member 386 forms side surfaces on the −Y axial direction side of the region 382 and the region 384*b*.

Also, as shown in FIG. 15, the left side surface member 305 is provided to cover the film member 335. Also, as shown in FIG. 16, the right side surface member 306 is provided to cover the film member 386.

Here, the ink containing section 300 is also referred to as a printing material containing chamber 300, the printing material supply section 280*a* is also referred to as a first printing material supply section 280*a*, and the printing material supply section 280*b* is also referred to as a second printing material supply section 280*b*. The main ink chamber 340 is also referred to as a main containing chamber 340, and the sub ink chamber 380 is also referred to as a sub containing chamber 380. The opening end 288*a* is also referred to as a first opening end 288*a*, and the opening end 288*b* is also referred to as a second opening end 288*b*. The region 382 is also referred to as a first sub containing chamber 382, the region 384*a* is also referred to as a second sub containing chamber 384*a*, and the region 384*b* is also referred to as a third sub containing chamber 384*b*. The film member 335 is also referred to as a first film member 335, and the film member 386 is also referred to as a second film member 386. The left side surface member 305 is also referred to as a first lid member 305, and the right side surface member 306 is also referred to as a second lid member 306. The second lid member 306 corresponds to the "lid member" described in the claims.

A-4. Filling Kit (Filling Device)

FIG. 23 is a first diagram for explaining an filling kit (filling device) 900. The filling kit (filling device) 900 has an filling unit 901. The filling unit 901 is an instrument for filling ink into the cartridge 20. The filling unit 901 has an filling needle 902, a printing material reservoir section 904, and a pressurizing section 905. The printing material reservoir section 904 and the filling needle 902 are connected. The filling needle 902 has an opening formed in a tip end portion 902*a* thereof. Ink reserved in the printing material reservoir section 904 can be filled into the ink containing section 300 through the opening of the tip end portion 902*a*. The pressurizing section 905 pressurizes the inside of the printing material reservoir section 904 by being pushing into the printing material reservoir section 904. As a result of this, ink in the printing material reservoir section 904 is pushed out to the filling needle 902. Incidentally, the pressurizing section 905 can be removed from the filling unit 901. Therefore, the filling unit 901 can replenish the printing material reservoir section 904 with ink.

Figure 24:
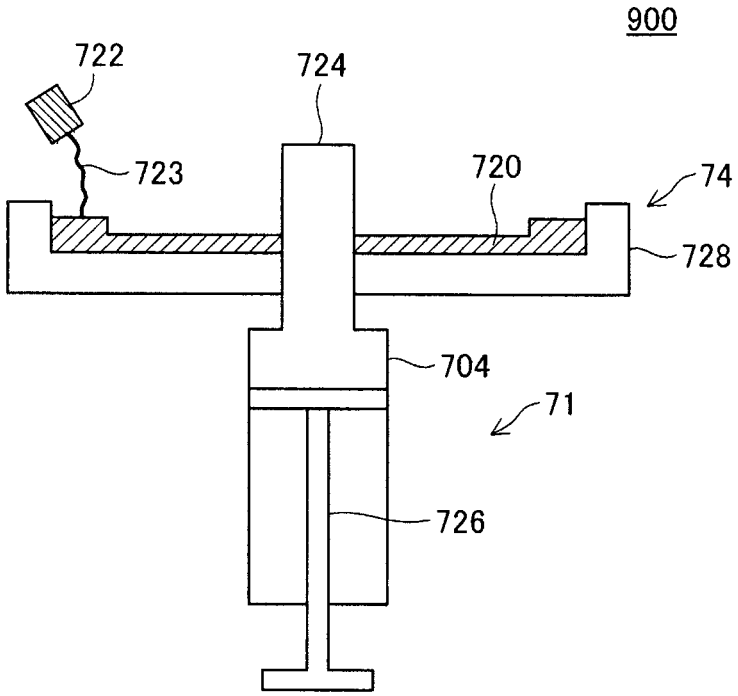
FIG. 24 is a second diagram for explaining an filling kit (filling device).
Figure 25:
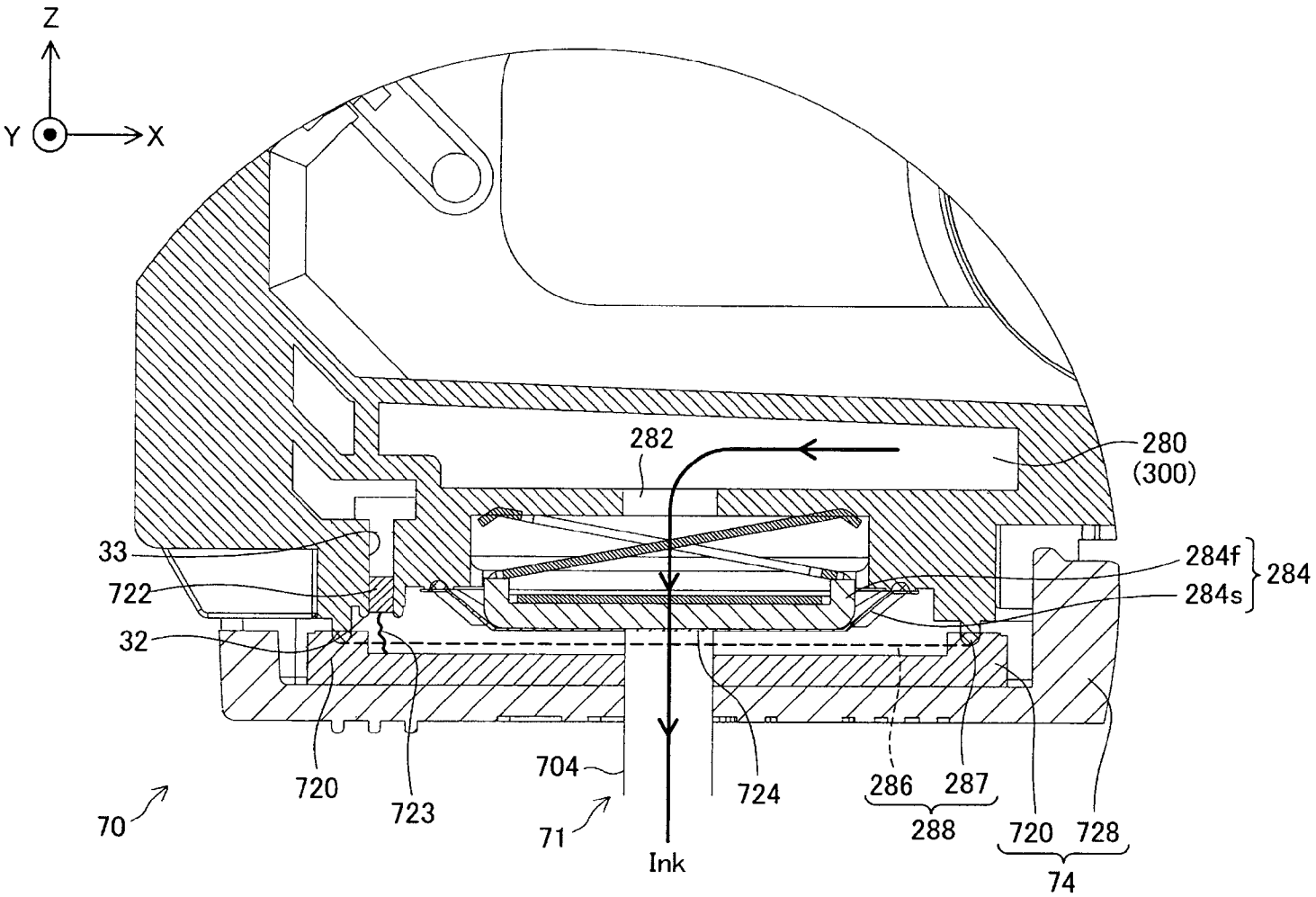
FIG. 25 is a third diagram for explaining an filling kit (filling device).

FIG. 24 is a second diagram for explaining the filling kit (filling device). FIG. 25 is a third diagram for explaining the filling kit (filling device). FIG. 25 illustrates a usage state of the instrument shown in FIG. 24. As shown in FIG. 24, the filling kit (filling device) 900 further has an aspirating unit 71, an opening closing unit 74, and an inner path closing unit 722. The aspirating unit 71 is an instrument for aspirating fluid in the ink containing section 300 from the ink supply section 280 to the outside. The opening closing unit 74 is an instrument for closing the opening end 288 of the ink supply section 280. The inner path closing unit 722 is an instrument for closing the inner path 33. The aspirating unit 71 has a case body 704 in which a tip end portion 724 is opened, and an aspirating section 726. As shown in FIG. 25, the aspirating section 726 is pulled while pressing the tip end portion 724 to the sheet member 284*s*, and the inside of the ink containing section 300 is aspirated to the outside through the ink supply section 280.

As shown in FIG. 24, the opening closing unit 74 has a seal member 720 and a containing member 728. As shown in FIG. 25, the seal member 720 adheres to the partition end section 287 without any gap so as to cover the opening 286. Consequently, it is possible to prevent ink from leaking to the outside through the opening end 288. The seal member 720 is made of an elastic member such as rubber, for example. The containing member 728 is a member for containing the seal member 720. The containing member 728 has a concave shape. The containing member 728 is made of synthetic resin such as polypropylene, for example. The outer shapes of the seal member 720 and the containing member 728 correspond to the outer shape of the opening end 288. In the present embodiment, the outer shapes of the seal member 720 and the containing member 728 are substantially elliptical. The aspirating unit 71 is provided to penetrate the substantially central portion of the opening closing unit 74.

The inner path closing unit 722 is a unit for closing the inner path 33. The inner path closing unit 722 is a member to be fitted into the inner path 33, for example. The inner path closing unit 722 is made of an elastic member such as rubber, for example. As shown in FIG. 25, it is possible to prevent ink from flowing into the inner path 33 by causing the inner path closing unit 722 to be fitted into the inner path 33. When ink is filled, the inner path closing unit 722 is connected with a sealing unit 736 by a linear connecting member 723 such that the inner path closing unit 722 is integral with the opening closing unit 74. Incidentally, the connecting member 723 may be omitted, and the inner path closing unit 722 does not need to be connected with other elements of the filling kit (filling device) 900. The inner path closing unit 722 may be a film member which does not allow ink to permeate.

A plurality of filling kits (filling devices) 900 may be combined depending on the specification of the cartridge 20. For example, in the present embodiment, one filling unit 901, two opening closing units 74, two aspirating units 71, and two inner path closing units 722 are used.

A-5. Ink Filling Method

Figure 26:
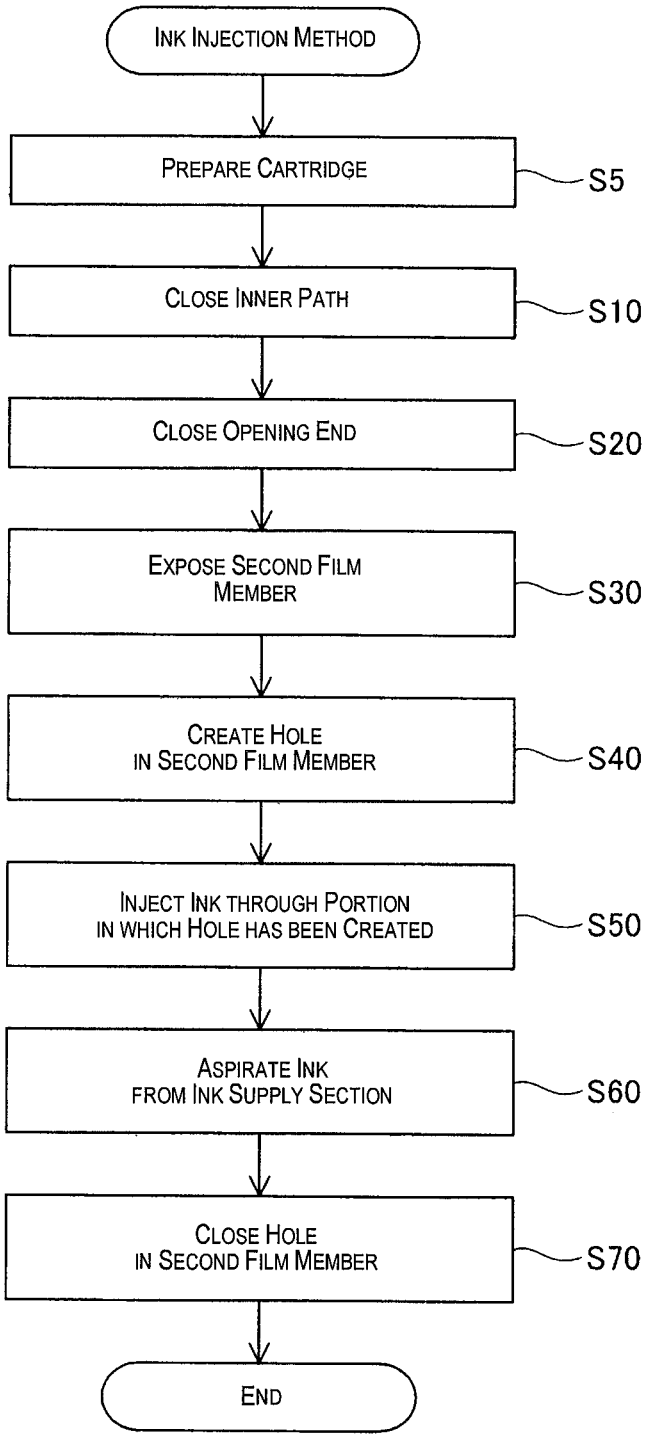
FIG. 26 is a diagram for explaining an ink filling flow.
Figure 27:
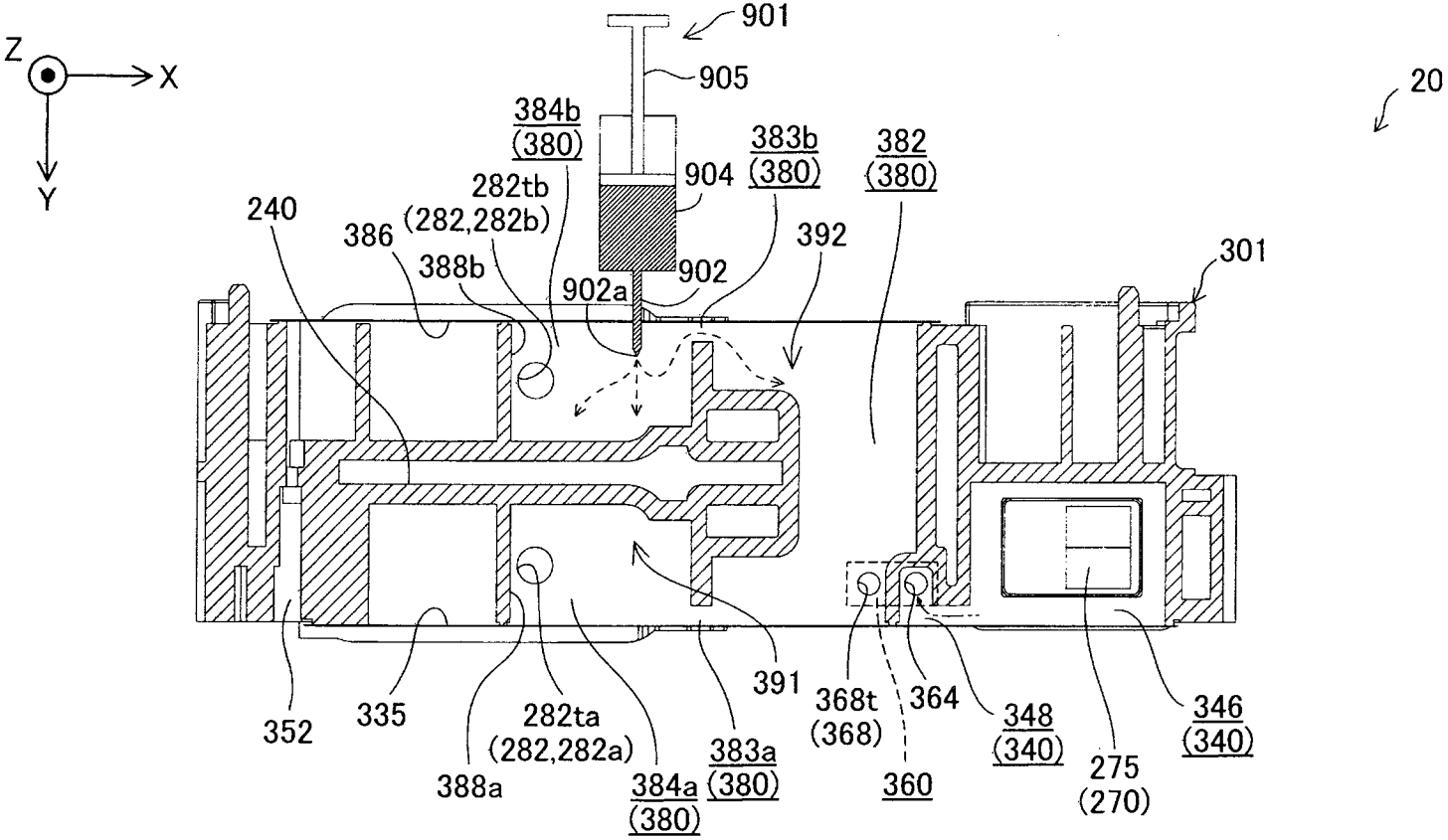
FIG. 27 illustrates a state of filling ink into a sub containing chamber.

FIG. 26 is a diagram for explaining an ink filling flow. FIG. 27 illustrates a state of filling ink into the sub containing chamber 380. In FIG. 27, the state of filling ink is shown by an arrow. The ink filling flow can be carried out, for example, when the cartridge 20 is refilled with ink after ink contained in the cartridge 20 is consumed and there is no more ink. The ink filling flow can also be carried out, for example, when the cartridge 20 is filled with ink during initial manufacturing of the cartridge 20. In the present embodiment, the ink filling flow is carried out to the cartridge 20 using the filling kit (filling device) 900. However, the filling kit (filling device) 900 does not need to be used for carrying out the ink filling flow to the cartridge 20, and any optional instrument can be employed. Also, the ink filling flow described below can be carried out while keeping the cartridge 20 in an optional state (position). In the explanation described below, the ink filling flow is carried out while keeping the cartridge 20 in the mounting state.

First, the cartridge 20 is prepared (step S5). The cartridge 20 is a target into which ink is filled. The first inner path 33*a* and the second inner path 33*b* (FIG. 7) are closed before filling ink into the cartridge 20 (step S10, FIG. 25). Further, the first opening end 288*a* and the second opening end 288*b* (FIG. 7) are closed before filling ink into the cartridge 20 (step S20, FIG. 25). Specifically, step 10 and step 20 are conducted using the opening closing unit 74 and the inner path closing unit 722 as shown in FIG. 25.

Further, a portion of the second film member 386 which forms the sub ink chamber 380 is exposed before filling ink into the cartridge 20 (step S30). Step 30 may be conducted by removing the second lid member 306 from the main body member 301, or a part of the second lid member 306 may be cut off such that the second film member 386 is exposed.

It is sufficient that the above-described step S10 to step S30 are conducted before filling ink, and the order of the above-described step S10 to step S30 does not matter.

After step S30, a hole is created in the second film member 386 and ink is filled from the sub ink chamber 380 through the portion in which the hole has been created, so that a predetermined amount of ink is contained in the printing material containing chamber 300 (steps S40, S50). More specifically, as shown in FIG. 27, the second film member 386 is pierced with the filling needle 902 of the filling unit 901, and ink in the printing material reservoir section 904 is filled into the sub ink chamber 380. Here, it is preferable that a predetermined amount (a first predetermined amount) of ink is contained in the cartridge 20 at the time of completion of the ink filling flow. The predetermined amount refers to an amount which allows at least the surface of the prism 275 to be immersed in ink in the mounting state. It is preferable that the predetermined amount of ink is contained in the printing material containing chamber 300 in step S50. As a result of this, it is possible to detect the presence or absence of ink using the prism 275 again after the ink is filled.

After step S50, ink contained in the ink containing section 300 is aspirated to the outside through the two ink supply sections 280*a*, 280*b* (step S60). More specifically, a predetermined amount (a second predetermined amount) of ink is aspirated to the outside through the printing material exit 284*s* by the aspirating unit 71. It is preferable to conduct step S60 in the mounting state (a state in which the ink supply section 280 is located on the downside in the gravity direction with respect to the printing material containing chamber 300), so that ink can be securely aspirated. In step 60, ink is aspirated to the outside until an upstream side portion of the ink supply section 280 including the printing material exit 284*s* (FIG. 20) is filled with the ink.

After step S60, the filling unit 901 is extracted from the second film member 386, and the hole created in the second film member 386 is closed (step 70). Step 70 is conducted, for example, by attaching a film member onto the second film member 386 to cover the hole from above. Also, in a case where the second lid member 306 (FIG. 16) is removed in step S30, the second lid member 306 is attached to the main body member 301 after step S70.

Here, the order of step S60 and step S70 does not matter as long as they are conducted after step S50.

A-6. Effects

As described above, in the first embodiment, a hole is created in the second film member 386 and ink is filled from the sub ink chamber 380 through the hole (steps S40, 50 of FIG. 26, and FIG. 27). Consequently, ink can be directly filled into the sub ink chamber 380 which is an element of the printing material containing chamber 300, and thus ink can be efficiently filled into the printing material containing chamber 300. Here, as shown in FIG. 15 and FIG. 17, the first film member 335 forms a side surface of the main ink chamber 340 in addition to a side surface of the sub ink chamber 380. Therefore, in a method for filling ink by piercing a portion of the first film member 335 where the sub ink chamber 380 is located with the filling unit 901, there are cases in which the main ink chamber 340 is pierced with the filling unit 901 inadvertently. In the present embodiment, however, ink is filled by piercing the second film member 386 with the filling unit 901 (steps S40, 50), and thus it is possible to prevent a hole from being created inadvertently in the main ink chamber 340. As shown in FIG. 15, the negative pressure generating member such as the elastic member 328, the plate member 325, and the like are arranged in the main ink chamber 340. Therefore, when an instrument for filling ink (for example, the filling unit 901) is inserted into the main ink chamber 340, there is fear that the member (for example, the negative pressure generating member) arranged in the main ink chamber 340 will be damaged. According to the ink filling method of the present embodiment, ink can be filled securely into a desired portion (in the present embodiment, the sub ink chamber 380). Also, in the present embodiment, ink is filled by creating a hole in the second film member 386 without creating a hole in the main body member 301. It is thus possible to prevent debris from being generated from the main body member 301.

As shown in FIG. 17, the prism 275 is arranged in the main ink chamber 340. When ink is filled from outside to the ink containing section 300, there are cases in which air bubbles will enter the ink. In such cases, air bubbles adhering to the prism 275 might cause false detection of the presence or absence of ink. In the present embodiment, it is possible to reduce the possibility that air bubbles generated during ink filling will reach and adhere to the prism 275 by filling ink from the sub ink chamber 380 in which the prism 275 is not arranged (steps S50, 60).

In step S50, the portion into which ink is filled may be located inside the third sub containing chamber 384*b*. Specifically, ink is filled while the tip end portion 902*a* of the filling needle 902 is placed inside the third sub containing chamber 384*b*. Here, as shown in FIG. 19, the flow path length Lt2 from the first port 368*t* to the third sub containing chamber 384*b* is longer than the flow path length Lt1 from the first port 368*t* to the second sub containing chamber 384*a*. Therefore, if ink is filled from another portion such as the second sub containing chamber 384*a*, ink does not easily reach the third sub containing chamber 384*b*. Consequently, there are cases in which it takes time to cause the ink to be contained in the third sub containing chamber 384*b*. In the present embodiment, however, ink is filled from the third sub containing chamber 384*b*, and thus ink can be filled efficiently into the third sub containing chamber 384*b* which is hard to contain ink. Among the sub containing chamber 380, the third sub containing chamber 384*b* has the longest flow path length to the prism 275. Therefore, even in a case where air bubbles are generated during ink filling, it is possible to reduce the possibility that the generated air bubbles will reach and adhere to the prism 275 by filling ink from the third sub containing chamber 384*b*.

In step S50, the portion into which ink is filled may be located inside the first sub containing chamber 382. Specifically, ink is filled while the tip end portion 902*a* of the filling needle 902 is placed inside the first sub containing chamber 382. By filling ink from the first sub containing chamber 382, ink is branched from the first sub containing chamber 382, and the ink can be filled in both of the second sub containing chamber 384*a* and the third sub containing chamber 384*b* at substantially the same time.

In the first embodiment, the first opening end 288*a* and the second opening end 288*b* are closed before filling ink (step S20 of FIG. 26, FIG. 25). It is thus possible to prevent ink from leaking out through the first opening end 288*a* and the second opening end 288*b* during ink filling. Also, in the first embodiment, the first inner path 33*a* and the second inner path 33*b* are closed before filling ink (step S10 of FIG. 26, FIG. 25).

It is thus possible to prevent ink, leaked from the printing material exit 284*s* of the ink supply section 280, from flowing into the first inner path 33*a* and the second inner path 33*b*. It is also possible to leak ink from the air introduction port 209 of the first communicating path 330*a* and the second communicating path 330*b* to the outside.

In the first embodiment, after step S50, ink is aspirated from the first ink supply section 280*a* and the second ink supply section 280*b* to the outside, respectively (step S60 of FIG. 26, FIG. 25). Consequently, ink can also be contained inside the first ink supply section 280*a* and the second ink supply section 280*b* (in more detail, the upstream side portion which includes the printing material exit 284*s*). It is thus possible to reduce the possibility that air will flow into the head 540 of the printer 50 from the cartridge 20, and to prevent trouble of the printer 50 (for example, damage to the head 540 or deterioration of printed image quality) from occurring due to so-called air shot of the head 540.

In the first embodiment, each process for filling ink can be implemented easily with the filling kit (filling device) 900. For example, the filling kit (filling device) 900 is provided with the filling unit 901, thereby making it possible to create a hole in the second film member 386 and easily fill ink into the sub containing chamber 380 through the hole (FIG. 23, FIG. 27). Also, for example, the filling kit (filling device) 900 is provided with the inner path closing unit 722, thereby making it possible to easily close the inner path 33 (FIG. 24, FIG. 25). Also, for example, the filling kit (filling device) 900 is provided with the opening closing unit 74, thereby making it possible to easily seal the opening end 288 (FIG. 24, FIG. 25). Also, the filling kit (filling device) 900 is provided with the aspirating unit 71, thereby making it possible to easily aspirate ink to the outside through the ink supply section 280 (FIG. 24, FIG. 25).

The cartridge 20 in which ink is contained in ink containing section 300 can be manufactured by conducting the processes of step S5 to step S70. In the manufactured cartridge 20, ink filling mark is formed in the second film member 386 by conducting the processes of step S40 and step S50.

B. Second Embodiment

B-1. Filling Method

Figure 28:
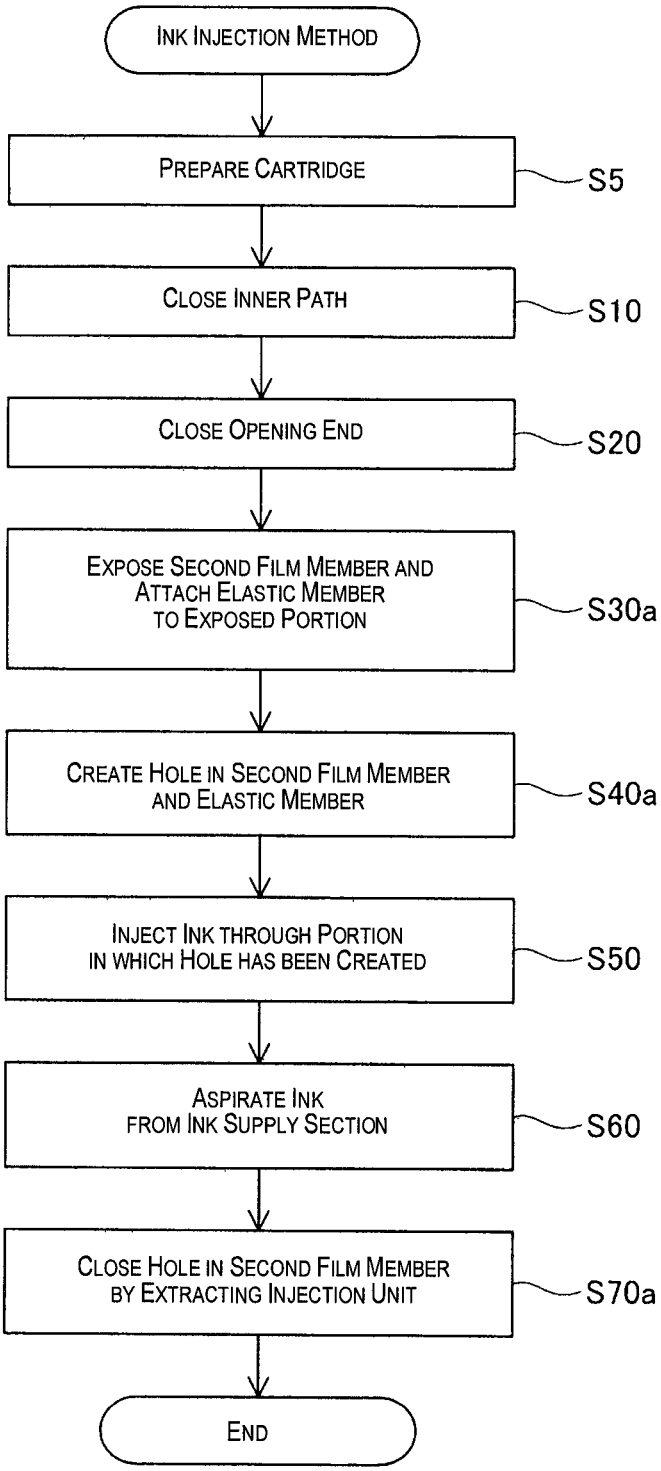
FIG. 28 is a diagram for explaining an ink filling flow according to a second embodiment.
Figure 29:
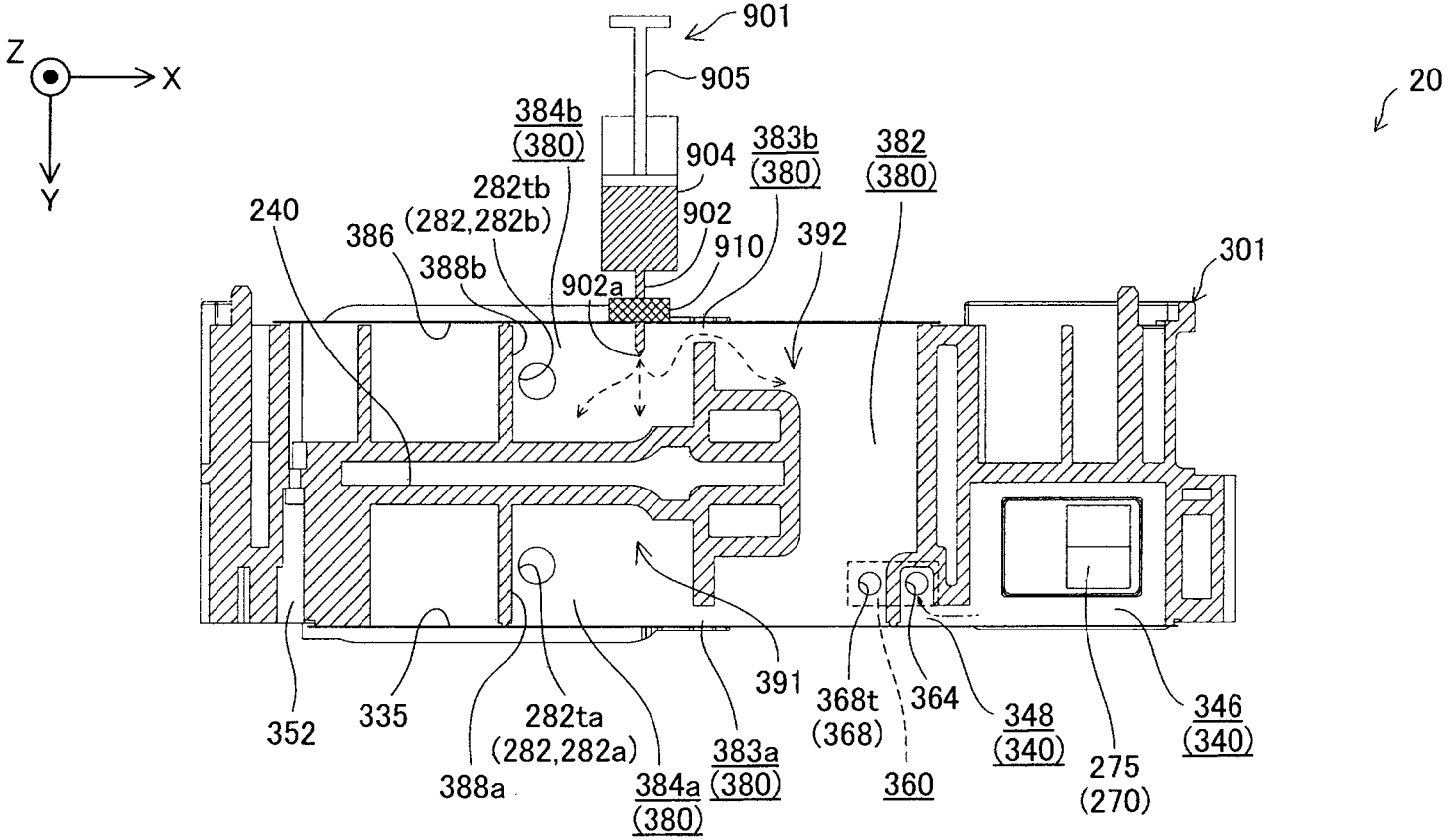
FIG. 29 illustrates a state of filling ink into a sub containing chamber.

FIG. 28 is a diagram for explaining an ink filling flow according to a second embodiment. FIG. 29 illustrates a state of filling ink into the sub containing chamber 380. In FIG. 29, the state of filling ink is shown by an arrow. The same reference numerals will be given with regard to the steps which are similar to the ink filling flow of the first embodiment, and the description thereof will be omitted. The ink filling flow of the first embodiment and the ink filling flow of the second embodiment are different in step S30*a*, step S40*a*, and step S70*a*. The ink filling flow of the second embodiment can be conducted using the filling kit (filling device) 900 explained in the first embodiment.

In step S30*a*, after exposing the second film member 386, an elastic member 910 (FIG. 29) is attached to the exposed portion. As for the elastic member 910, a solid member which has elasticity by being formed with rubber or the like is used. In step S40*a*, as shown in FIG. 29, a hole is formed in the elastic member 910 and the second film member 386 by piercing the elastic member 910 and the portion of the second film member 386 where the elastic member 910 is attached with the filling needle 902. In step S70*a*, the hole formed in the second film member 386 is closed with the elastic member 910 by extracting the filling needle 902 from the elastic member 910 and the second film member 386. More specifically, the hole in the elastic member 910 closes by its elasticity, and the hole in the second film member 386 is closed by the elastic member 910. Here, the elastic member 910 may be added as an element of the filling kit (filling device) 900. Also, in a case where the second lid member 306 (FIG. 16) is removed in step S30*a*, the second lid member 306 is attached to the main body member 301 after step S70*a*.

The cartridge 20 in which ink is contained in the ink containing section 300 can be manufactured by conducting the processes of step S5 to step S70*a*. In the manufactured cartridge 20, the elastic member 910 is attached to the second film member 386 by conducting the process of step S30*a*.

B-2. Effects

In the above-described second embodiment, the hole in the elastic member 910 closes by extracting the filling unit 901 (step S70*a* of FIG. 28). Since the hole in the elastic member 910 closes, the hole formed in the second film member 386 can be closed. Therefore, the hole formed in the second film member 386 can be closed by the operation of extracting the filling unit 901, and the manufacturing process can be simplified compared to the ink filling flow of the first embodiment. Further, the hole in the second film member 386 is closed at substantially the same timing as the timing when the filling unit 901 is extracted. Therefore, it is possible to reduce the possibility that ink will leak to the outside through the hole in the second film member 386. Also, in the second embodiment, the configurations having features similar to the first embodiment achieve effects similar to the first embodiment. For example, it is possible to prevent a hole from being opened inadvertently in the first film member 335 by creating a hole in the second film member 386 and filling ink through the hole in the second film member 386 (step S30*a*).

C. Modified Example

Elements other than the elements described in the independent claims of the claims among the elements of the above-described embodiments are additional elements, and can be omitted as appropriate. Also, the present invention is not limited to the above-described embodiments, and various aspects are possible within a scope which does not depart from the gist of the present invention. For example, modifications described below are possible.

C-1. First Modified Example

The present invention can be implemented with the following embodiments. For reference, the reference numerals corresponding to the embodiments are given with regard to each of the elements.

Aspect 1

A method for manufacturing a cartridge (20) which contains a printing material to be supplied to a printing device (50), the method including: a step (a) of preparing the cartridge (20) which has a main body member (301), a first film member and a second film member (335, 386) attached to the main body member (301), so as to sandwich the main body member (301), a lid member (306) attached to the main body member (301) to cover the second film member (386), a main containing chamber (340) for containing the printing material defined by the main body member (301) and the first film member (335), a sub containing chamber (380) for containing the printing material defined by the main body member (301), the first film member (335), and the second film member (386), and a first and a second printing material supply sections (280*a*, 280*b*) for supplying the printing material to the printing device (50) and communicating with the sub containing chamber (380), the sub containing chamber (380) being communicating with the main containing chamber (340); a step (b) of exposing at least a portion of the second film member (386); a step (c) of filling the printing material from the sub containing chamber (380) by creating a hole in the second film member (386) so as to cause the printing material to be contained in the main containing chamber (340) and the sub containing chamber (380) after the step (b); and a step (d) closing the hole after the step (c).

According to the aspect 1, it is possible to prevent a hole from being opened inadvertently in the first film member which is positioned on the opposite side of the second film member when filling the printing material. As a result of this, it is possible to create a hole securely in the second film member, and it is thus possible to prevent a hole from being opened inadvertently in the first film member which forms the main containing chamber Further, at least one of the above-described aspects (2) to (7) may be dependent on the above-described aspect 1.

C-2. Second Modified Example

The present invention is not limited to an ink jet printer or an ink cartridge thereof and it is possible to also apply the present invention to arbitrary liquid ejection devices which eject liquid other than ink and cartridges (liquid containing containers) used for the liquid ejection devices. For example, it is possible to apply the present invention to cartridges used for the following various types of liquid ejection devices. Further, the filling kit (filling device) 900 or the ink filling method of the above embodiments can be applied to cartridges used for the following various types of liquid ejection devices.

- Image recording devices such as a facsimile device
- Colorant material ejection devices which are used in manufacturing color filters which are used in image display devices such as liquid crystal displays
- Electrode material ejection devices which are used in forming electrodes such as in organic EL (Electro Luminescent) displays and field emission displays (FED)
- Liquid ejection devices which eject a liquid which includes a bioorganic material which is used in manufacturing biochips
- Sample ejection devices as precision pipettes
- Lubricating oil ejection devices
- Resin liquid ejection devices
- Liquid ejection devices which eject lubricating oil in a pin-point manner in precision machinery such as clocks and cameras
- Liquid ejection devices which eject a transparent resin liquid such as an ultraviolet curing resin liquid onto a substrate in order to form a small semispherical lens (an optical lens) which is used in optical communication elements or the like Liquid ejection devices which eject an acid or alkali etching liquid in order to carry out etching of a substrate or the like Other arbitrary liquid ejection devices which are provided with a liquid ejection head which discharges liquid droplets in small amounts.

Here, "liquid droplet" refers to a state of liquid which is discharged from the liquid ejection device and includes liquid with particle shapes, liquid with teardrop shapes, and liquid which draws out a trail with a thread shape. In addition, it is sufficient if the "liquid" referred to here is a material which is able to be ejected from the liquid ejection device. For example, it is sufficient if the "liquid" is in a state where a substance is in a liquid phase, and materials in a liquid state such as materials with a liquid state where the viscosity is high or low and materials with a liquid state such as sols, gel water, other inorganic solvents, organic solvents, solutions, liquid resins, and liquid metals (metal fusion liquids) are included as "liquids". In addition, not only liquids as one state of a substance but where particles of a functional material which are formed as a solid material such as a pigment or metal particles are dissolved, dispersed, or mixed in a solvent are included as "liquids". In addition, ink as described in the embodiments described above, liquid crystals, or the like are given as representative examples of the liquid. Here, various types of liquid compositions such as typical water-based inks, oil-based inks, shell inks, and hot melt inks are included as ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for manufacturing a cartridge which contains a printing material to be supplied to a printing device, the method comprising:

a step (a) of preparing a cartridge which has a printing material containing chamber for containing the printing material, and first and second printing material supply sections which supply the printing material contained in the printing material containing chamber to the printing device, the printing material containing chamber including a main containing chamber, a sub containing chamber which branches the printing material contained in the main containing chamber so as to the printing material flows into the first and second printing material supply sections, a first port through which the printing material contained in the main containing chamber flows into the sub containing chamber, a second port through which the printing material contained in the sub containing chamber flows into the first printing material supply section, and a third port through which the printing material contained in the sub containing chamber flows into the second printing material supply section, the sub containing chamber including a first sub containing chamber in which the first port is provided, a second sub containing chamber in which the second port is provided, and a third sub containing chamber in which the third port is provided, and the cartridge further including a first film member which is provided on a +Y axial direction side of the cartridge and forms side surfaces on the +Y axial direction side of the main containing chamber, the first sub containing chamber, and the second sub containing chamber, respectively, a second film member which is provided on a −Y axial direction side of the cartridge and forms side surfaces on the −Y axial direction side of the first sub containing chamber and the third sub containing chamber, respectively, and a lid member which is provided to cover the second film member;

a step (b) of exposing at least a portion of the second film member;

a step (c) of filling the printing material from the sub containing chamber by creating a hole in the second film member so as to cause the printing material to be contained in the printing material containing chamber after the step (b); and a step (d) of closing the hole after the step (c).

2. The method for manufacturing a cartridge according to claim 1, wherein in the cartridge prepared in the step (a), a flow path length from the first port to the third sub containing chamber is longer than a flow path length from the first port to the second sub containing chamber, and a portion into which the printing material is filled in the step (c) is located inside the third sub containing chamber.

3. The method for manufacturing a cartridge according to claim 1, wherein a portion into which the printing material is filled in the step (c) is located inside the first sub containing chamber.

4. The method for manufacturing a cartridge according to claim 1, wherein the step (b) includes a step of attaching an elastic member to an exposed portion of the second film member, the hole in the second film member in the step (c) is formed by piercing the elastic member and the exposed portion with an filling tool for filling the printing material into the printing material containing chamber, and the step (d) is a step of extracting the filling tool from the elastic member and the exposed portion.

5. The method for manufacturing a cartridge according to claim 1, further comprising a step (e) of closing a first opening end which is located in an end portion of the first printing material supply section and a second opening end which is located in an end portion of the second printing material supply section before filling the printing material in the step (c).

6. The method for manufacturing a cartridge according to claim 1, wherein the cartridge prepared in the step (a) further includes a first communicating path which connects the inside and the outside of the first printing material supply section and a second communicating path which connects the inside and the outside of the second printing material supply section, one end side of the first communicating path is a first inner path which is provided inside the first printing material supply section, and one end side of the second communicating path is a second inner path which is provided inside the second printing material supply section, the method further comprising a step (f) of closing the first and second inner paths before filling the printing material in the step (c).

7. The method for manufacturing a cartridge according to claim 1, further comprising a step (g) of aspirating the printing material contained in the printing material containing chamber to the outside through the first and second printing material supply sections after the step (c).

8. A cartridge manufactured by the method for manufacturing a cartridge according to claim 1.

9. An filling kit for filling a printing material into a printing material containing chamber of a cartridge which has the printing material containing chamber for containing the printing material, and first and second printing material supply sections which supply the printing material contained in the printing material containing chamber to the printing device, the printing material containing chamber including a main containing chamber, a sub containing chamber which branches the printing material contained in the main containing chamber so as to the printing material flows into the first and second printing material supply sections, a first port through which the printing material contained in the main containing chamber flows into the sub containing chamber, a second port through which the printing material contained in the sub containing chamber flows into the first printing material supply section, and a third port through which the printing material contained in the sub containing chamber flows into the second printing material supply section, the sub containing chamber including a first sub containing chamber in which the first port is provided, a second sub containing chamber in which the second port is provided, and a third sub containing chamber in which the third port is provided, and the cartridge further including a first film member which is provided on a +Y axial direction side of the cartridge and forms side surfaces on the +Y axial direction side of the main containing chamber, the first sub containing chamber, and the second sub containing chamber, respectively, a second film member which is provided on a −Y axial direction side of the cartridge and forms side surfaces on the −Y axial direction side of the first sub containing chamber and the third sub containing chamber, respectively, and a lid member which is provided to cover the second film member, the filling kit comprising:

an filling unit configured and arranged to fill the printing material into the printing material containing chamber from the outside.

10. The filling kit according to claim 9, further comprising an elastic member to be attached to the second film member.

11. The filling kit according to claim 9, further comprising an opening closing unit configured and arranged to close a first opening end which is located in an end portion of the first printing material supply section and a second opening end which is located in an end portion of the second printing material supply section.

12. The filling kit according to claim 9, further comprising an inner path closing unit configured and arranged to close a first inner path which is provided inside the first printing material supply section so as to connect the inside and the outside of the first printing material supply section and a second inner path which is provided inside the second printing material supply section so as to connect the inside and the outside of the second printing material supply section.

13. The filling kit according to claim 9, further comprising an aspirating unit configured and arranged to aspirate the printing material from the first and second printing material supply sections to the outside, respectively.

14. An filling device for filling a printing material into a printing material containing chamber of a cartridge which has the printing material containing chamber for containing the printing material, and first and second printing material supply sections which supply the printing material contained in the printing material containing chamber to the printing device, the printing material containing chamber including a main containing chamber, a sub containing chamber which branches the printing material contained in the main containing chamber so as to the printing material flows into the first and second printing material supply sections, a first port through which the printing material contained in the main containing chamber flows into the sub containing chamber, a second port through which the printing material contained in the sub containing chamber flows into the first printing material supply section, and a third port through which the printing material contained in the sub containing chamber flows into the second printing material supply section, the sub containing chamber including a first sub containing chamber in which the first port is provided, a second sub containing chamber in which the second port is provided, and a third sub containing chamber in which the third port is provided, and the cartridge further including a first film member which is provided on a +Y axial direction side of the cartridge and forms side surfaces on the +Y axial direction side of the main containing chamber, the first sub containing chamber, and the second sub containing chamber, respectively, a second film member which is provided on a −Y axial direction side of the cartridge and forms side surfaces on the −Y axial direction side of the first sub containing chamber and the third sub containing chamber, respectively, and a lid member which is provided to cover the second film member, the filling device comprising:

an filling unit which configured and arranged to fill the printing material into the printing material containing chamber from the outside.

15. The filling device according to claim 14, further comprising an elastic member to be attached to the second film member.

16. The filling device according to claim 14, further comprising an opening closing unit configured and arranged to close a first opening end which is located in an end portion of the first printing material supply section and a second opening end which is located in an end portion of the second printing material supply section.

17. The filling device according to claim 14, further comprising an inner path closing unit configured and arranged to close a first inner path which is provided inside the first printing material supply section so as to connect the inside and the outside of the first printing material supply section and a second inner path which is provided inside the second printing material supply section so as to connect the inside and the outside of the second printing material supply section.

18. The filling device according to claim 14, further comprising an aspirating unit configured and arranged to aspirate the printing material from the first and second printing material supply sections to the outside, respectively.

* * * * *